US005130726A

United States Patent [19]

Fukushima et al.

[11] Patent Number: 5,130,726

[45] Date of Patent: Jul. 14, 1992

[54] INK JET RECORDING APPARATUS

[75] Inventors: Kyoko Fukushima; Jiro Moriyama, both of Yokohama; Kimio Nishitani, Tokyo, all of Japan

[73] Assignee: Canon Kabushiki Kaisha, Tokyo, Japan

[21] Appl. No.: 486,202

[22] Filed: Feb. 28, 1990

[30] Foreign Application Priority Data

| | | | |
|---|---|---|---|
| Feb. 28, 1989 | [JP] | Japan | 1-47415 |
| Mar. 10, 1989 | [JP] | Japan | 1-56141 |
| Mar. 17, 1989 | [JP] | Japan | 1-67099 |
| Mar. 29, 1989 | [JP] | Japan | 1-74902 |

[51] Int. Cl.[5] ..... B41J 2/005; B41J 2/17

[52] U.S. Cl. ..... 346/140 R; 346/25; 346/134

[58] Field of Search ..... 346/140, 1.1, 140 R, 346/25, 134; 400/320, 322

[56] References Cited

U.S. PATENT DOCUMENTS

| | | | |
|---|---|---|---|
| 4,161,670 | 7/1979 | Kern | 346/140 |
| 4,271,347 | 6/1981 | Svenson | 219/121 L |
| 4,275,402 | 6/1981 | Kern | 346/140 |
| 4,313,124 | 1/1982 | Hara | 346/140 R |
| 4,340,893 | 7/1982 | Ort | 346/1.1 |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,469,026 | 9/1984 | Irwin | 101/426 |
| 4,558,333 | 12/1985 | Sugitani et al. | 346/140 R |
| 4,617,580 | 10/1986 | Miyakawa | 346/140 |
| 4,723,129 | 2/1988 | Endo et al. | 346/1.1 |
| 4,740,796 | 4/1988 | Endo et al. | 346/1.1 |
| 4,847,638 | 7/1989 | Moriyama | 346/140 R |

FOREIGN PATENT DOCUMENTS

| | | | |
|---|---|---|---|
| 0025878 | 4/1981 | European Pat. Off. . | |
| 2932422 | 4/1980 | Fed. Rep. of Germany . | |
| 3431484 | 3/1985 | Fed. Rep. of Germany . | |
| 54-107735 | 8/1979 | Japan . | |
| 59-123670 | 7/1984 | Japan . | |
| 59-138461 | 8/1984 | Japan . | |
| 61-35841 | 2/1986 | Japan . | |
| 209163 | 9/1986 | Japan | 346/140 |
| 62-101483 | 5/1987 | Japan . | |
| 639800 | 11/1983 | Switzerland . | |

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

An ink jet recording apparatus includes a recording head for ejecting recording liquid to perform recording operation on a recording medium; a laser source, disposed facing to the recording medium, for projecting a laser beam on the recording medium; and a control device responsive to a record signal supplied to the recording head for the recording operation to control the laser source to project the laser beam from the laser source onto the recording medium.

33 Claims, 25 Drawing Sheets

NON

OHP

PAPER

FIG. 30(A)
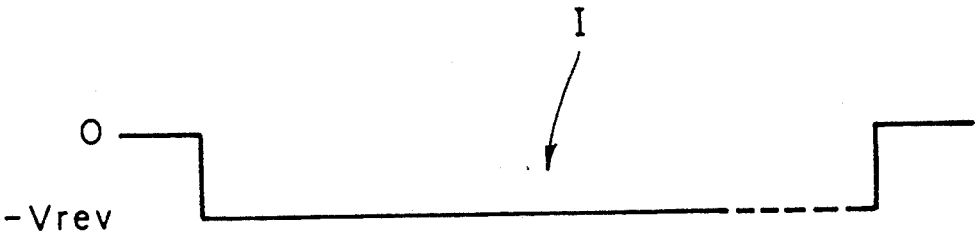
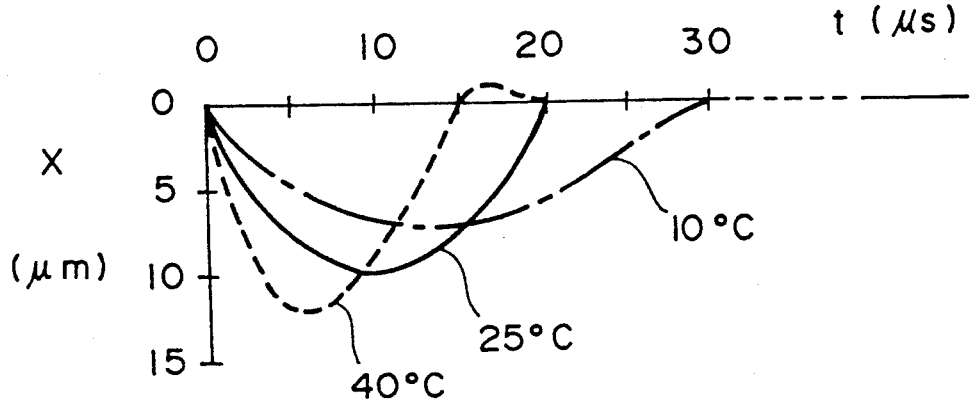
FIG. 30(B)

INK JET RECORDING APPARATUS

FIELD OF THE INVENTION AND RELATED ART

The present invention relates to an ink jet recording apparatus in which ink is ejected for the recording operation and which is usable with a copying apparatus, a facsimile machine, a word processor or a computer.

The ink jet recording apparatus is constructed such that fine droplets of the ink are ejected from a discharge opening of the recording head using piezoelectric elements or electrothermal transducers as ejecting means and are deposited on a recording material. It is particularly noted because the noise is small, and a high speed and/or full-color recording is possible.

In the general structure thereof, the recording material (or sheet) is fed by feeding rollers or the like to the recording position, where ink droplets are deposited through the discharge openings of the recording head onto the recording sheet disposed at the recording position, so that one line recording of an image is carried out. During the recording operation in accordance with the data to be recorded, the sheet is fed line by line (line feeding).

When there is space between images, or when there is a blank line or lines, the form feeding which is at a higher speed than the line feeding is performed to increase the overall recording speed.

After the completion of the recording operation, the recording sheet is discharged by the form feeding.

FIG. 1 is a flow chart illustrating a conventional series of recording operations in such a recording apparatus. Upon the start of the recording operation, the sheet is fed at step S91, by which the recording sheet is fed to the recording position. Subsequently, at step S92, the sheet feed is started, and at step S93, the recording operation is performed. During the recording operation, the sheet is fed line by line to record the image or characters.

When the end of the recording operation is detected at step S94, that is, when the completion of the recording operation on one recording sheet or one page of the recording paper is detected, the sheet is discharged by the form feeding at step S95, by which the recording operation for one recording sheet ends.

The droplet of the recording liquid ejected from the ink jet recording head for the image formation is deposited on the recording sheet, and it is partly absorbed by the recording paper, and the rest is present on the surface of the recording paper.

Since in the ink jet recording system, watercolor recording liquid is desired, the recording sheet is desirably good in the absorption and fixing property relative to the recording liquid. Particularly in the multi-color ink jet recording system using more than two recording liquids, the quantity of the recording liquid deposited on the recording paper is large, and therefore, the absorbing and fixing property of the recording liquid is required to be excellent. To meet this, particular paper having a coating layer providing good absorbing property is used as the recording paper. However, the recent demand is for the direct recording on such a recording medium as plain paper without the coating layer or OHP (overhead projector) film, which does not easily absorb the ink.

On the other hand, the half-tone production method of the ink jet recording type contains a digital type using a dither method and an analog type using an area modulation. The former is advantageous in that a small quantity of the ink is required for a picture element to produce the tone gradation, but the resolution is not best. The latter is good in the resolution, and therefore, the image quality is better, but the quantity of the ink is larger.

When the analog type is used in which a larger quantity of the ink is deposited per one droplet, or wherein a larger quantity of the ink is deposited by plural ejections, the paper is discharged before the deposited ink is completely absorbed, and therefore, it is possible that a pinch roller or a paper guide along the sheet discharge passage contacts the ink not absorbed and remaining on the film, and sometimes contaminate the recording paper or the apparatus.

According to the prior art recording operation illustrated in FIG. 1, when, for example, only one line of characters is recorded on one recording sheet (one page in the case of rolled paper), and the rest of the recording sheet is blank, the sheet or paper is discharged by the form feeding operation after the completion of the one line recording. As a result, the ink of the record is contacted to the sheet discharging mechanism without being fixed, and the above-described contamination results by the unfixed ink.

The recording medium such as the sheet exclusively for the ink jet recording and the OHP film are different in the ink absorption quantity, the ink absorbing speed, the coloring properties or the like. Therefore, even when the same recording image density is to be provided, for example, the recording modes have to be different. In order to meet this in one apparatus, separate operating modes are used.

U.S. Pat. No. 4,617,580 discloses a system wherein the position where the ink droplets are deposited is different depending on whether the OHP film or the paper is used. However, it is difficult to solve the problem of the fixing property of the ink in the recording sheet only by the change of the mode.

Japanese Laid-Open Patent Application No. 107735/1979, Japanese Laid-Open Utility Model Application 35841/1986 and Japanese Laid-Open Patent Application No. 101483/1987 disclose as a means for improving the fixing properties in the OHP film or the like that a heat generating means is disposed at a position facing the recording material to dry and fix the recorded image on the recording material by irradiating the heat or applying hot air to the recording material using the heat of the heat generating means.

U.S. Pat. No. 4,469,026 discloses that the conveying speed of the recording paper is controlled, and the ink deposited on the recording paper is fixed. In addition, an image is fixed by passing the recording paper having the formed image on a hot plate.

However, in the method wherein the recording paper is subjected to the drying or moisture removing operation, the temperature is not uniform because of non-uniform temperature rise of the heating source and/or due to the heat radiation, and therefore, it is practically difficult to apply heat radiation with proper temperature in a predetermined region.

It is considered that the conveying speed of the recording paper during the printing operation is lowered for the purpose of improvement in the image fixation. However, this results in lower recording speed, and therefore, it is not proper for a high speed recording in the ink jet recording apparatus.

Furthermore, when the recording paper having recorded images thereon is passed on the hot plate, the recording sheet warps depending on the degree of the heating and the quantity of the ink on the recording paper, that is, the recording paper is elongated in the area where the ink is deposited, so that the surface of the recording paper warps. This is not preferable.

The fixing of the ink on the recording paper is dependent on the ambient conditions (humidity and/or temperature).

As shown in FIG. 2, certain ink for the ink jet recording apparatus has a viscosity of approximately 6.3 cps at 25° C., 12 cps or higher at the temperature of 10° C. or lower, and approximately 4 cps at 40° C. Thus, it changes significantly in the range of the temperature.

The change of the viscosity relates to the quantity of the ink ejected, more particularly, when the viscosity is low, a larger quantity of the ink is ejected under a predetermined ejection pressure, and on the contrary, when the viscosity is high, smaller quantity of the ink is ejected.

This problem arises similarly irrespective of whether it is a type of using thermal energy for ejecting the ink, or it is of the type of using the pressing operation of a piezoelectric element. Particularly where the piezoelectric element is used, the temperature change results in the density change of the recorded image.

SUMMARY OF THE INVENTION

Accordingly, it is an object of the present invention to provide an ink jet recording apparatus wherein only the proper part of the recorded area is assuredly heated without temperature non-uniformness, and particularly, a temperature of a drying and fixing means is prevented from increasing, by using a laser beam.

It is another object of the present invention to provide an ink jet recording apparatus wherein only the proper area of the recorded region is heated and fixed, and a time period is provided for the purpose of fixing the ink before the recording sheet is discharged, whereby the ink is assuredly fixed on the recording paper without decreasing the recording speed during the printing, and the contamination of the apparatus or the recording paper by the ink is prevented.

It is a further object of the present invention to provide a liquid jet recording apparatus using a piezoelectric element, wherein the energy and the energy application timing to the piezoelectric element is variable to be adjusted in accordance with the temperature properties so that the position of a meniscus of the ink is at a predetermined position, whereby good recorded images can be provided.

It is a further object of the present invention to provide an ink jet recording apparatus wherein recording modes are provided for plain paper and for OHP sheet, and the good fixing property can be provided by fixing only the recorded area by a laser beam and by controlling paper discharging timing.

According to an aspect of the present invention, there is provided an ink jet recording apparatus, comprising:

a recording head for ejecting recording liquid to perform recording operation on a recording medium;

a laser source, disposed faced to the recording medium, for projecting a laser beam onto the recording medium; and control means responsive to a record signal supplied to said recording head for the recording operation to control said laser source to project the laser beam from the laser source onto the recording medium.

According to another aspect of the present invention, there is provided an ink jet recording apparatus, comprising:

an ink jet recording head for ejecting recording ink onto a recording medium for recording operation;

a laser source for projecting a laser beam onto the recording medium;

conveying means for feeding the recording medium to a recording region where said recording head performs the recording operation and for discharging it from the recording region;

control means responsive to a record signal for the recording operation by said recording head to control laser beam production by the laser source; and conveyance control means for controlling said conveying means to stop the recording medium when a unit of recording operations is ended, and a predetermined period thereafter, to resume operation of said conveying means.

According to a further aspect of the present invention, there is provided an ink jet recording apparatus, comprising:

means for detecting material of recording medium on which a recording operation is effected;

recording head operable in a first recording mode and in a second recording mode selectively in accordance with an output of said detecting means;

first control means for controlling a time period from an end of the recording operation to a start of discharging of the recording medium, in accordance with an output of said detecting means; and second control means for controlling, in accordance with an output of said detecting means, laser beam production by a laser source which is disposed faced to a recording region wherein said recording head performs the recording operation.

According to a further aspect of the present invention, there is provided an ink jet recording apparatus, comprising:

means for detecting whether a recording medium on which a recording operation is effected is plain paper or OHP material;

control means for driving the recording head for forming a record by ejecting ink in a first recording mode when said detecting means detects the plain paper material or in a second recording mode when the OHP material is detected; and means for controlling a laser source disposed faced to a recording region where the recording operation is performed by said recording head to emit a laser beam when said detecting means detects the OHP material.

According to a further aspect of the present invention, there is provided an ink jet recording apparatus, comprising:

recording head provided with a discharge opening for discharging a droplet of ink;

conveying means for conveying a recording medium on which an image is formed by deposition of the droplets of the ink ejection from said recording head;

means for discriminating presence, absence and material of the recording medium;

a laser source disposed faced to a recording region where said recording head effects the recording operation; and means for controlling production of a laser beam by said laser source in accordance with an output of said discriminating means.

According to a further aspect of the present invention, there is provided a liquid jet recording apparatus wherein a piezoelectric element provided for a recording chamber communicating with an ejection outlet is supplied with electric energy, so that the recording liquid chamber is expanded, and then is contracted, by which the recording liquid is ejected through said outlet to a recording medium, comprising:

temperature detecting means for detecting a temperature of the recording liquid; and control means responsive to an output of said detecting means to control at least one of a level or application period of electric energy supplied to the piezoelectric element when the recording liquid is expanded.

The laser source functions as a drying and fixing means by projecting on the recorded region of the recording material. Therefore, the temperature of the drying and fixing means itself is not increased, and therefore, the temperature of the recording head is not increased. The laser beam from the laser source is incident on the recording material in a very limited area and position. Since the laser source is provided on the recording head, the laser beam is projected to the portions where the ink is deposited on the recording material, that is, where the projection is necessary. In addition, the laser beam projected is in accordance with the recording signal, and therefore, wasteful heating is not required.

Since the recording mode is selectable in accordance with the material of the recording medium, and the laser beam projection or the sheet discharging time are controlled, so that the image fixation is very good without the contamination of the recording material and the recording apparatus, and therefore, the quality of the recorded image is improved.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 30(A) and 30(B) illustrates the position of meniscus in relation to the voltage applied and the temperature in an apparatus according to an embodiment of the present invention.

DESCRIPTION OF THE PREFERRED EMBODIMENTS

Referring to accompanying drawings, preferred embodiments of the present invention will be described.

Figure 3:
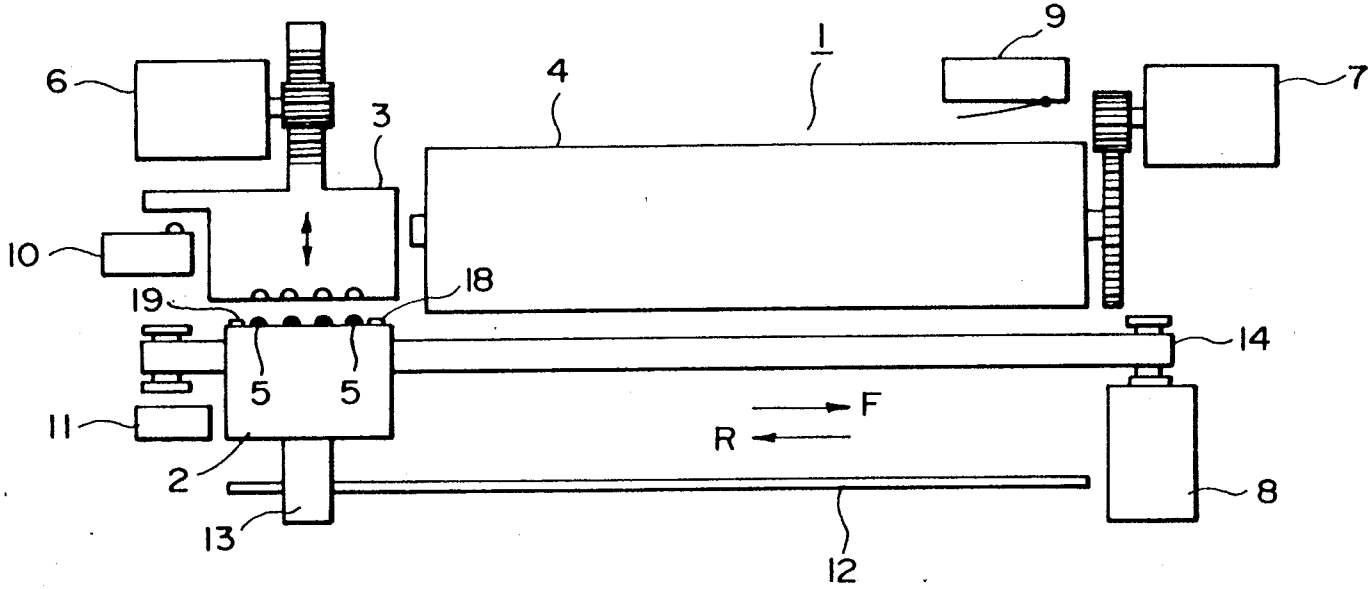
FIG. 3 is a schematic view of a mechanical system of an ink jet recording apparatus according to a first embodiment of the present invention.

Referring to FIG. 3, there is shown an ink jet recording apparatus 1 according to a first embodiment of the present invention, wherein a recording head 2 is fixedly mounted on a carriage which is slidable in the directions indicated by arrows F and R along a platen 4 which will be described hereinafter. The recording head 2 is driven together with the carriage by a carriage motor 8 through a belt 14, the carriage motor 8 being a DC motor.

Figure 4:
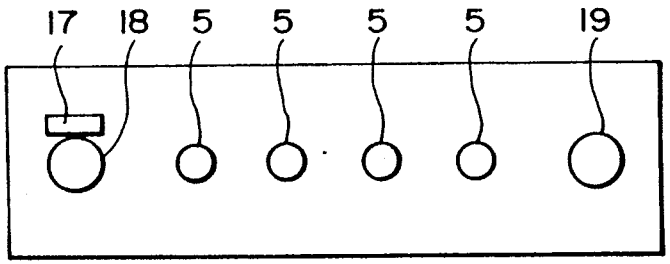
FIG. 4 is an enlarged front view of a recording head 2 used in the apparatus of FIG. 3.

Referring to FIG. 4, a front view of the recording head 2 is schematically shown. The recording head 2 is provided with discharge openings 5 for ejecting the ink to the recording medium 15 not shown in FIG. 3, but shown in FIG. 6. In addition, the recording head 2 is provided with an electrothermal transducer for producing thermal energy to be used for formation of droplets of the ink. In place thereof, the recording head 2 may be of a piezoelectric type wherein an electro-mechanical converting element is used for the production of the energy for the ink ejection. On extensions of the array of the discharge openings 5, that is, the left and right ends of the recording head 2, a laser source 18 and a laser source 19 are disposed at F direction end and at R direction end, respectively. The laser sources 18 and 19 serve to heat the portion or position where the ink is deposited on the recording medium 15. On a side of the laser source 18, a photosensor 17 is juxtaposed as shown in FIG. 4, although it is not shown in FIG. 3.

For the purpose of the recovery from the ink ejection trouble through the discharging openings 5 of the recording head 2, an ink absorbing cap movable by a cap motor 6 is used. The position of the cap 3 is detected by a cap sensor 10. The platen 4 has a surface which is black in color, and is rotationally driven by a line feed motor 7 comprising a stepping motor to feed the recording medium 15. The presence or absence of the recording medium is detected by a mechanical type paper sensor 9. Simultaneously with the discrimination between the presence and absence of the recording medium, the discrimination may be made as to whether the recording medium is plain paper or OHP paper, with the structure which will be described hereinafter.

The home position sensor 11 serves to detect the home position which is a reference position of the recording head when the position thereof is detected. A linear encoder 12 and an encoder sensor 13 are used to detect the position when the recording head 2 is moved.

Figure 5:
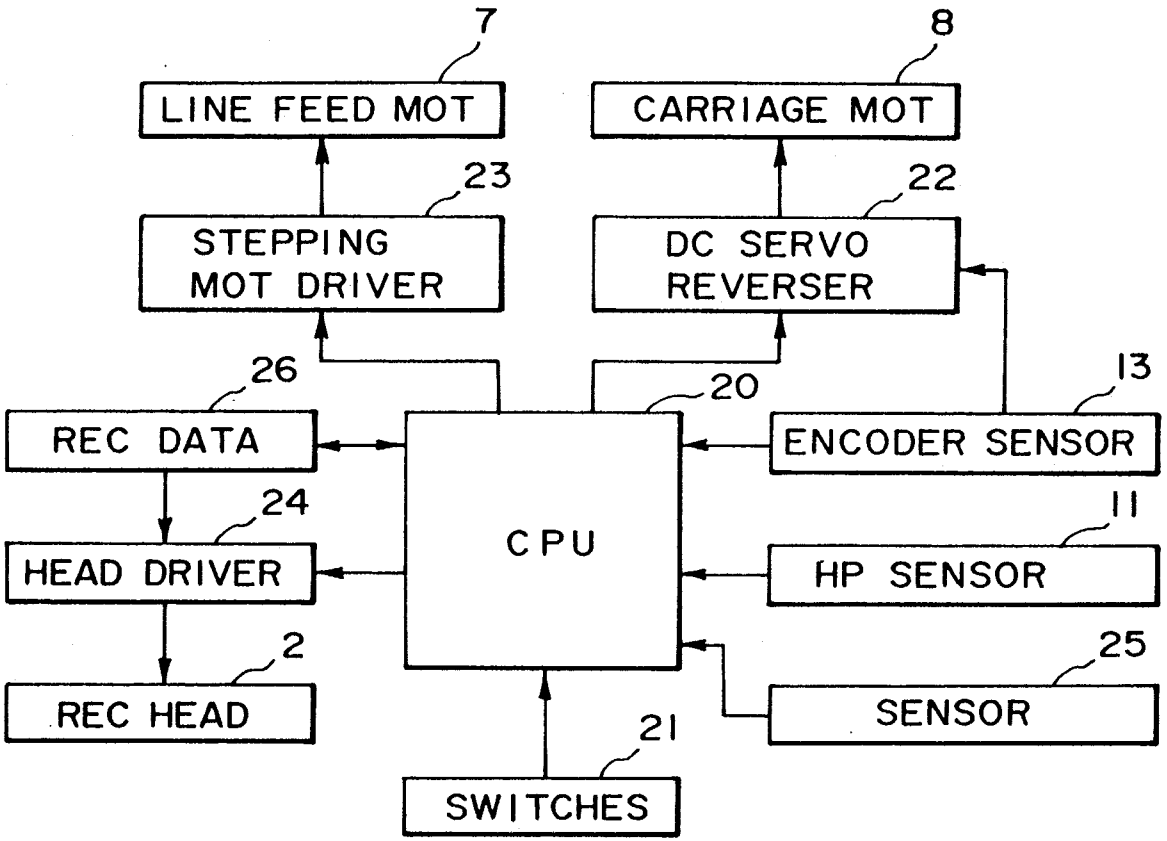
FIG. 5 is a block diagram of a control system of an ink jet recording apparatus shown in FIG. 3.

FIG. 5 shows a control system of the ink jet recording apparatus 1 of FIG. 3, wherein a central processing unit (CPU) 20 performs the following control operation in accordance with operational input made by actuating the switches 21 on an unshown operating panel. More particularly, referring to the input from the encoder sensor 13 and the home position sensor 11, the carriage motor 8 is driven through a DC servo reversing circuit 22 to control the moving direction and moving speed of the recording head. It also controls the driving of the line feed motor 7 through a stepping motor driving circuit 23. The recording data 26 transferred from an external control apparatus such as a computer is transferred to a head driver 24 as a recording signal to eject a droplet of the ink from the recording head 2 toward the recording surface of the recording medium 15. The control system is a so-called drop-on-demand system in which the ejection of the ink droplet is controlled for the respective drops. In response to the inputs from other sensors 25, other mechanisms not shown are controlled.

In addition, the CPU 20 carries out the following control. When the data relating to the size of the recording medium 15 or recording data 26 are given, a recording area 31 is discriminated from the recording data 26, and in addition, the results of the recording head position detection using the home position sensor 11, the linear encoder 12 and the encoder sensor 13 are received. On the basis of the results received, the laser sources 18 and 19 are actuated upon detection that the laser sources 18 and 19 are on the recording area 11.

The CPU 20 also functions as a control means for controlling actuation of the laser by the laser sources 18 and 19 through an unshown laser oscillation circuit on the head driver 24.

Figure 6:
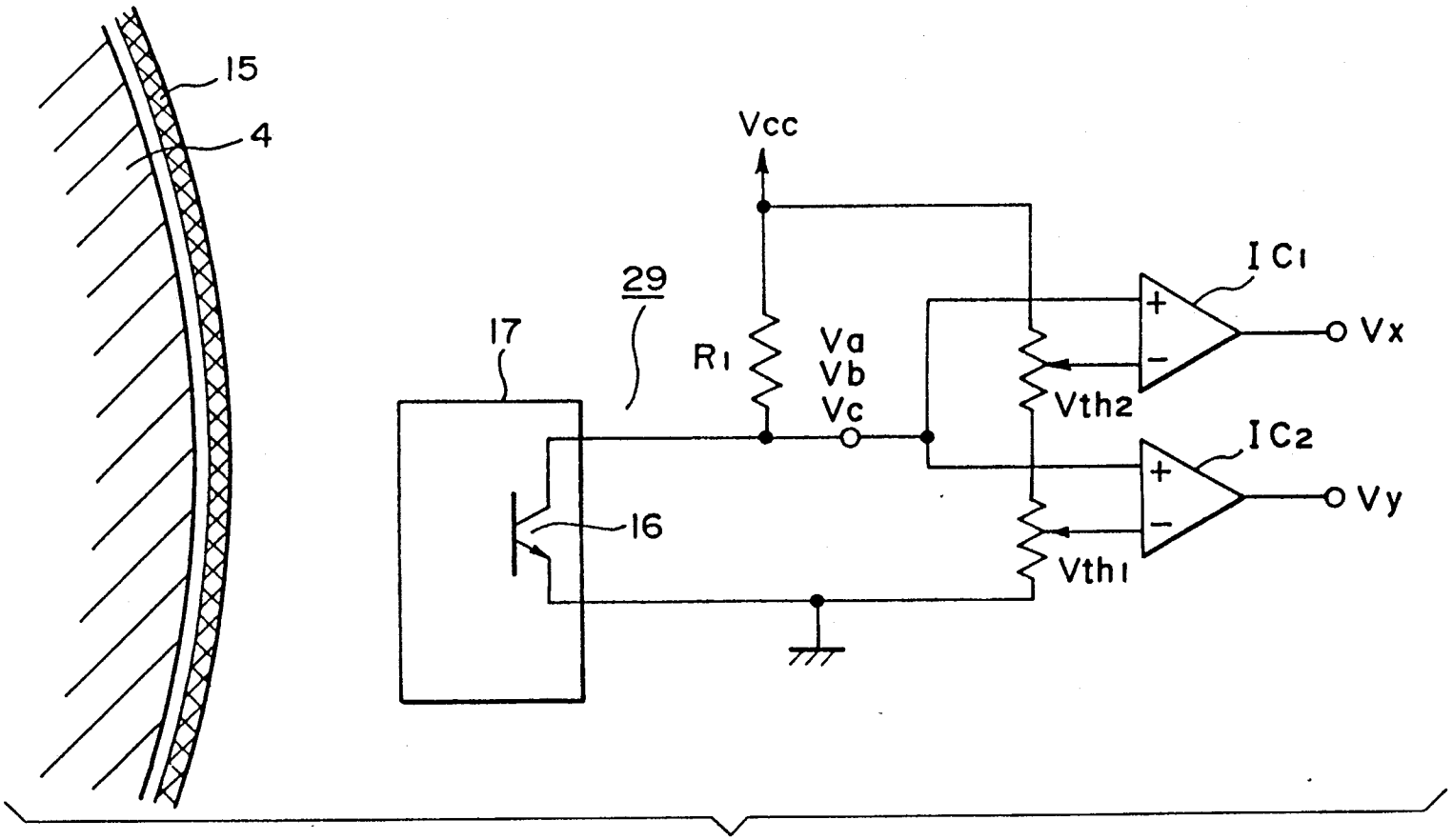
FIG. 6 is a circuit diagram of a reflected light detecting circuit including the photosensor shown in FIG. 4.

The CPU 20 receives detection signals Vx and Vy from a reflection light detecting circuit 29, shown in FIG. 6. The reflection light detecting circuit 29 is disposed in a photosensor 17 and compares an output voltage from a phototransistor 16 pulled up to the voltage source voltage Vcc through a resistor R1 with reference voltages Vth2 and Vth1 by comparators IC1 and IC2, respectively to produce detection signals Vx and Vy.

Figure 7:
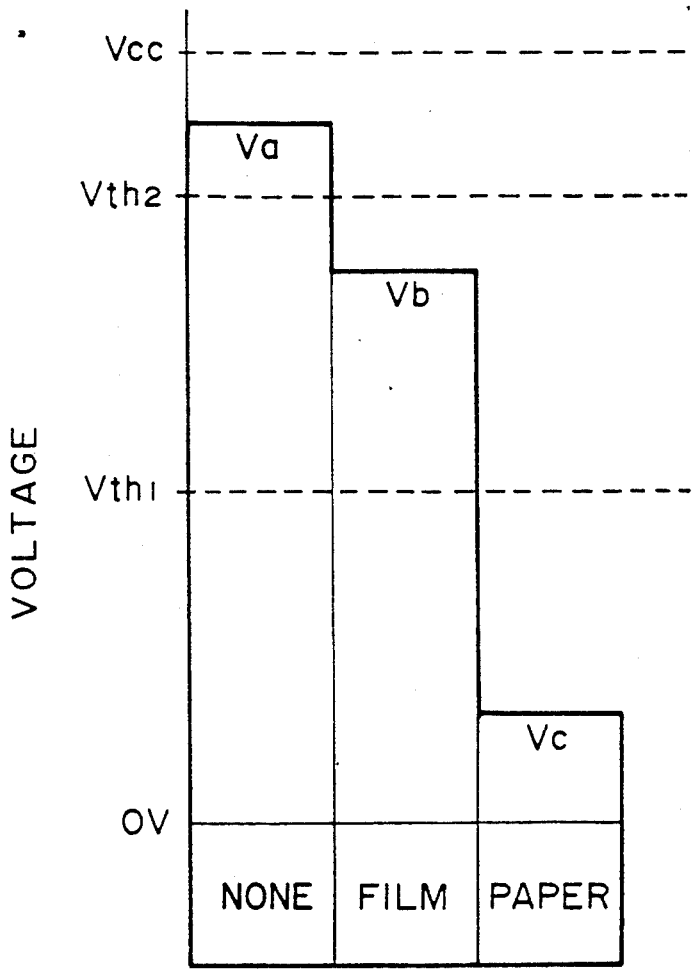
FIG. 7 illustrates the difference in the output voltage of the photosensor depending on the material of the recording medium.

When the recording medium 15 is not set on the platen 4, the laser beam is hardly reflected from the laser source 18 because the surface of the platen 4 is black, and therefore, the internal resistance of the phototransistor 16 is high. The output voltage Va of the phototransistor 16, as shown in FIG. 7 ("none"), is close to the source voltage Vcc. When, on the other hand, white plain paper is set on the platen 4, the laser beam from the laser source 18 is strongly reflected thereby, upon which the internal resistance of the phototransistor 16 is low. The output voltage Vc of the phototransistor 16 is close to 0 V (ground), as shown in FIG. 7 by "paper". When a transparent film (recording medium 15) is set on the platen 4, it is between paper and slightly closer to "none". The output voltage Vb of the phototransistor 16, as shown in FIG. 5 by "film", is between the output voltages Va and Vc and slightly close to the output voltage Va.

As shown in FIG. 7, the reference voltage Vth2 is set between the output voltage Va and the output voltage Vb, and the reference voltage Vth1 is set between the output voltage Vb and the output voltage Vc. As will be understood from a Table 1 below, the discrimination can be made from logical levels of the detection signals Vx and Vy as to whether the recording medium 15 is not on the platen 4 ("none"), the film is set on the platen 4 ("film"), or the plain paper is set on the platen 4 ("paper").

TABLE 1

| | None | Film | Paper |
|---|---|---|---|
| Vx | H | L | L |
| Vy | H | H | L |

In place of the laser oscillation circuit and the laser source 18, a light source for emitting usual light substantially without the heating power, such as a light emitting diode may be used, in which the light emitted by the light source and reflected by the platen or the like may be detected by the reflection light detecting circuit 29.

The presence or absence of the recording medium, and the material of the recording medium may be detected in another manner which will be described.

Figure 8:
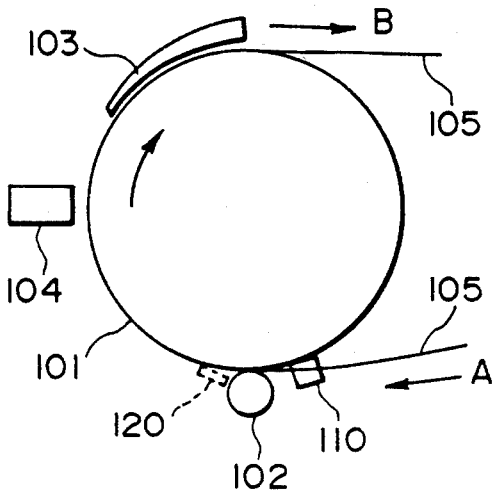
FIG. 8 is a side view of a sheet feeding mechanism in an ink jet recording apparatus according to an embodiment of the present invention.

FIG. 8 is a side view of a sheet feeding mechanism of an ink jet recording apparatus according to an embodiment of the present invention. It comprises a platen roller 101 for establishing a recording surface of the recording medium 105 and for feeding the recording medium 105, a pinch roller 102 disposed adjacent to the platen 101 to feed the recording medium, a guide 103 for feeding the recording medium 105 (paper or OHP sheet) in a direction B, and a recording head faced to the recording surface of the recording medium 105 for ejecting the ink.

A transparent type sensor 110 functions to discriminate the presence, absence or the material of the recording medium 105. If the sensor is of a reflection type, a reflection type sensor 20 is used.

With the structure described above, the recording medium 105 is fed in the direction A by the couple of rollers, i.e., the platen roller 101 and the pinch roller 102, by which it is automatically fed to a predetermined record starting position. During the feeding operation, the recording medium 105 passes by the detecting position of the recording material discriminating sensor, by which the presence or absence and the material of the recording medium is discriminated. In response to the detection, the recording mode is selected. More particularly, in response to the output from the discrimination sensor, the operation of the apparatus is stopped with display of "no paper", an OHP sheet recording mode is set, or paper recording mode is set.

The discrimination will be made as to the case wherein the recording material discriminating sensor is a transparent type sensor.

Figure 9:
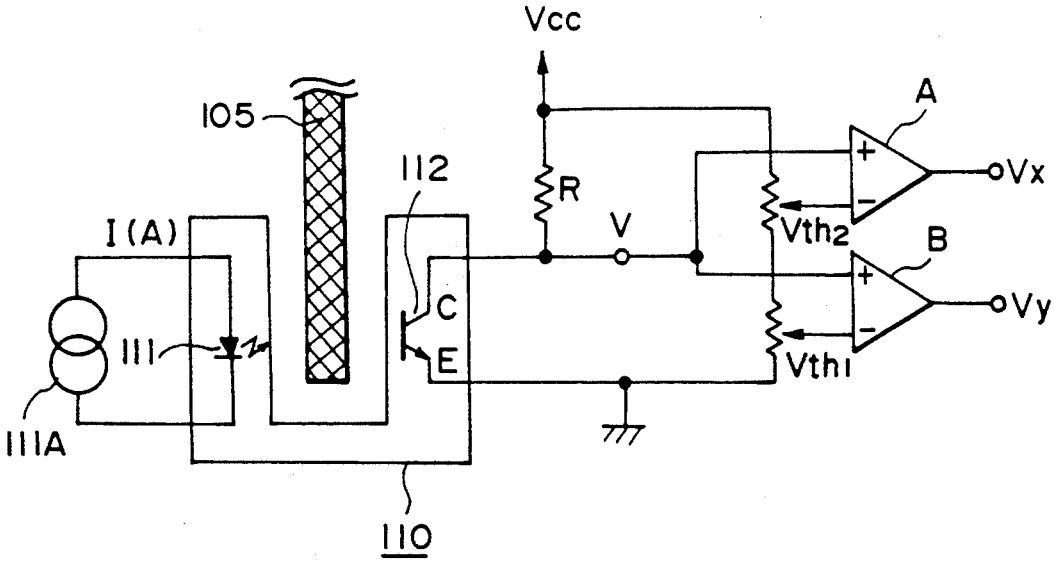
FIG. 9 is a circuit diagram of a discriminating circuit using a transparent type sensor, according to an embodiment of the present invention.

FIG. 9 shows a detection circuit and a detection mechanism when a transparent type sensor 110 is used. It comprises a light emitting diode (LED) 111 and a phototransistor 112. The LED 111 is supplied with a current I (30 mA) from a constant current source 111A to emit light. The phototransistor 112 is an emitter E connected to zero potential and a collector C connected to a voltage source Vcc (5 V) through a resistor R. The sensitivity of the phototransistor 112 to light has a peak for the wavelength around 820 nm to detect infrared light.

Figure 10:
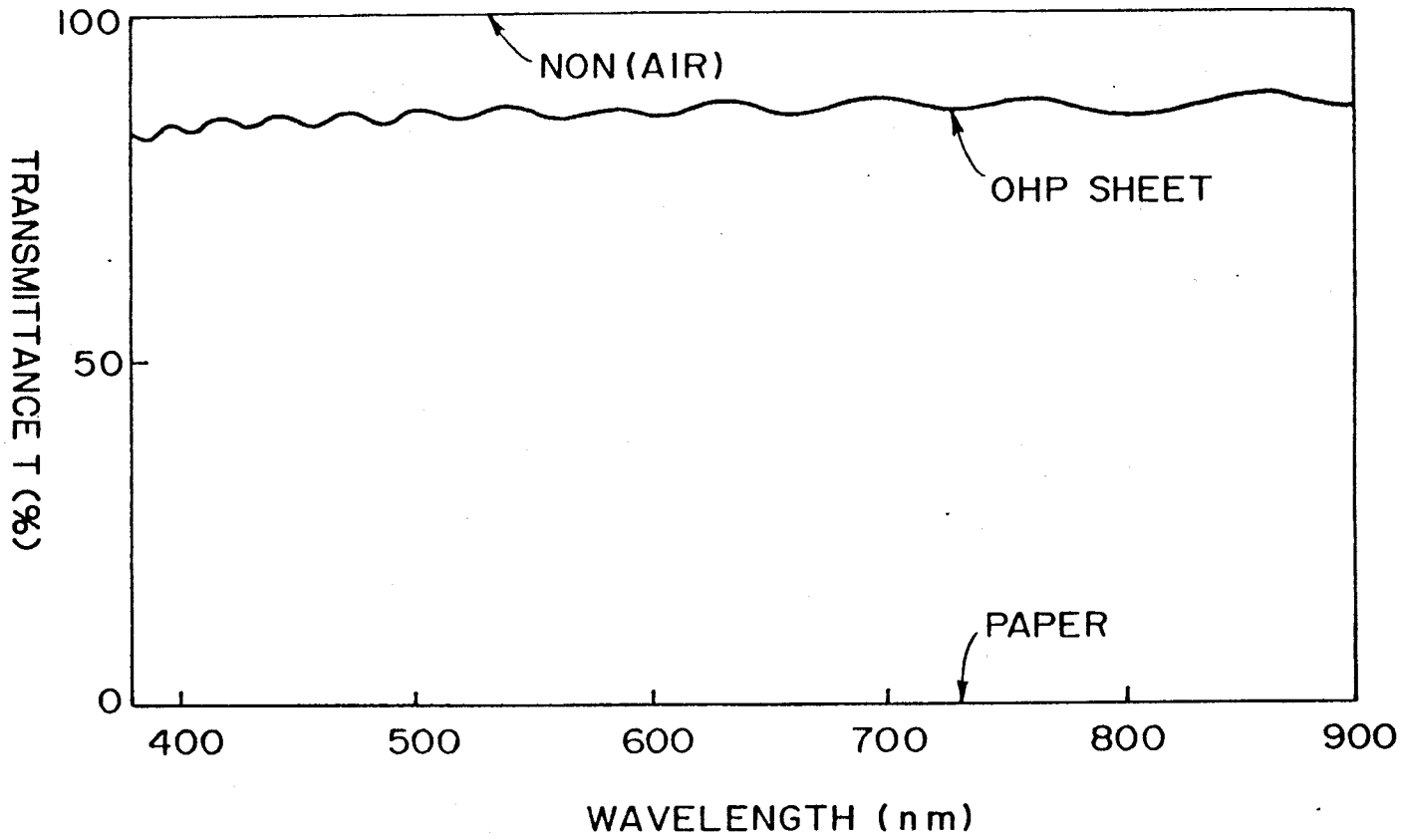
FIG. 10 is a diagram of transmission factor of the recording material.

FIG. 10 shows transmissivity T (%) of the recording medium for various wavelengths λ (nm) in various states, measured by a spectro-photometer. The states include a state (a) wherein there is no recording medium (air), a state (b) wherein an OHP sheet is set, and a state (c) wherein paper is set. It is understood that in the state (a), the transmissivity T is 100%; in the state (b), it is 80–90%; and when in the state (c), it is 0% always.

The potential difference V across the phototransistor 112 is compared with reference voltages Vth2 and Vth1 by comparators A and B, and the results of comparison are produced by the comparators A and B as detection signals Vx and Vy.

Figure 11:
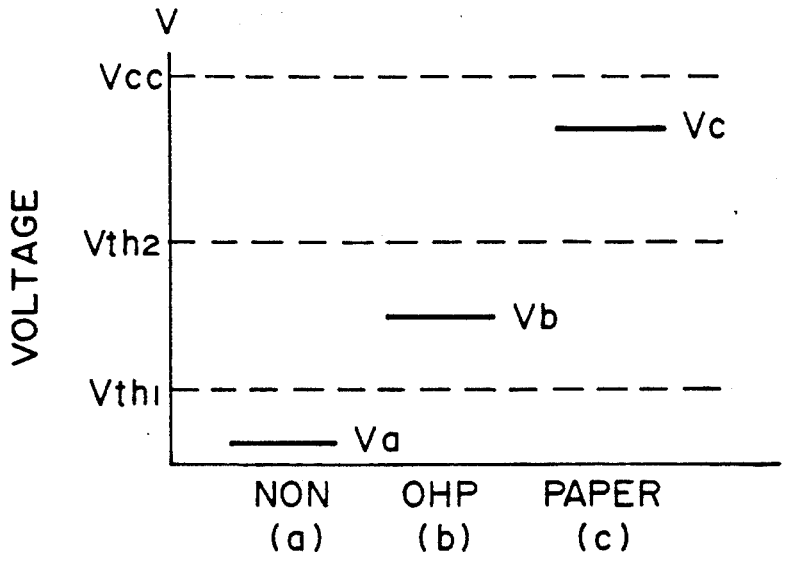
FIG. 11 is a diagram showing the output of a sensor shown in FIG. 9.

FIG. 11 shows potential differences V corresponding to the presence, absence and the material of the recording medium 105 on the basis of the light reception by the phototransistor 112. When the recording medium 105 is a normal sheet of paper, the light is not passed, and therefore, no current flows through the phototransistor 112. Then, the potential difference Vc is close to the voltage Vcc. By selecting proper output resistance R of the phototransistor 112, the differences among no recording medium (a), the OHP film (b) and paper (c) are maximized, and threshold voltages are determined such that the threshold voltage Vth1 is equal to an average of the no paper voltage Va and the OHP film voltage Vb, and the threshold voltage 2 is an average of the OHP film voltage Vb and the paper voltage Vc.

Using this structure, the discrimination can be easily made in the following manner. When the detection signals Vx and Vy are both "L", that is, when $V<Vth$, and $V<Vth2$, there is no recording medium (a); when the signal Vx is "L", and the signal Vy is "H", that is, when $Vth1<V<Vth2$, an OHP film is set (b); and when the signals Vx and Vy are both "H", that is, when $Vth1<V$, and $Vth2<V$, the paper is set (c). The sensor described above has the peak sensitivity for the infrared wavelength region, but as will be understood from the characteristics shown in FIG. 10, the peak may be in the visible light wavelength region.

Figure 12:
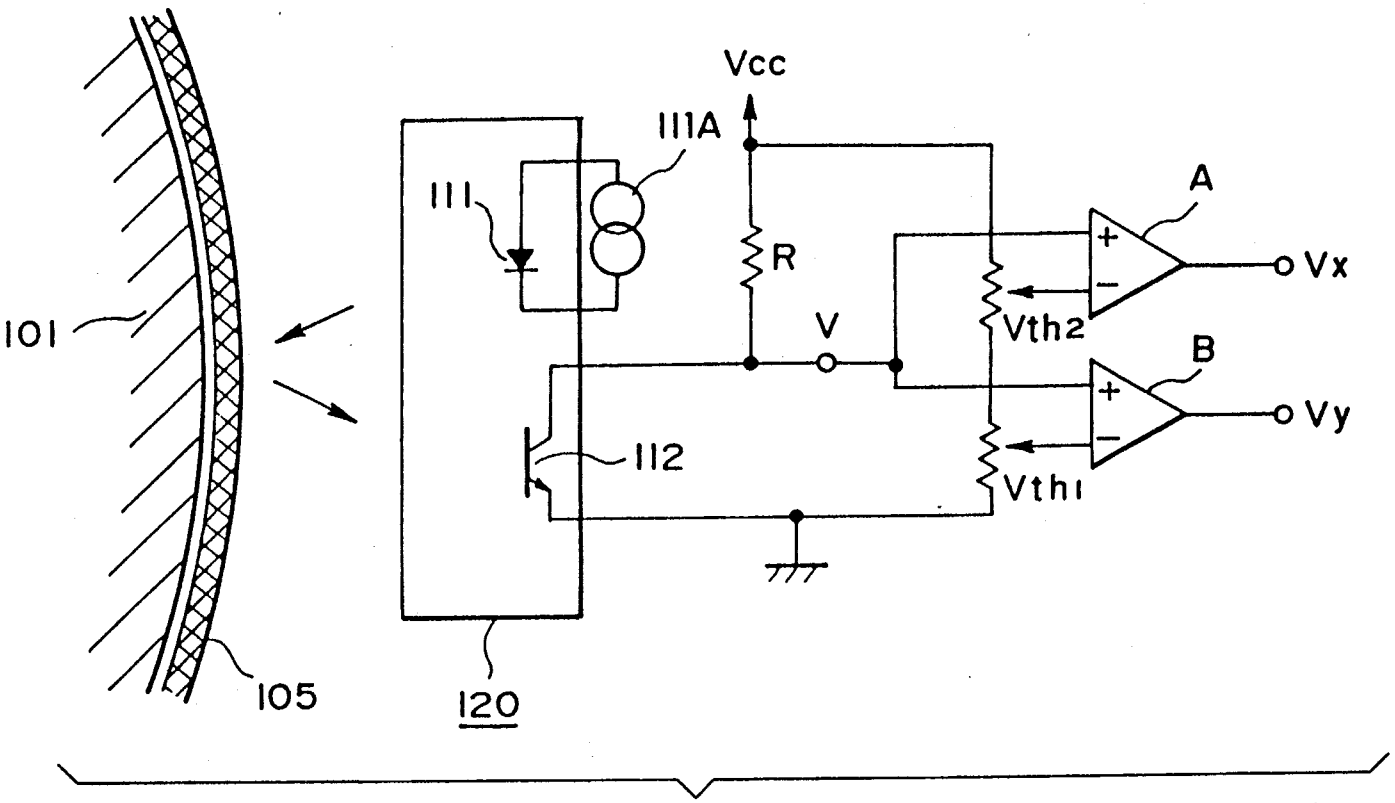
FIG. 12 is a circuit diagram of a discriminating circuit using a reflection type sensor, according to another embodiment of the present invention.

Referring to FIG. 12, the description will be made as to another discrimination sensor which is of a reflection type. FIG. 12 shows a detection circuit and a detection mechanism when a reflection type sensor 120 is used.

Figure 13:
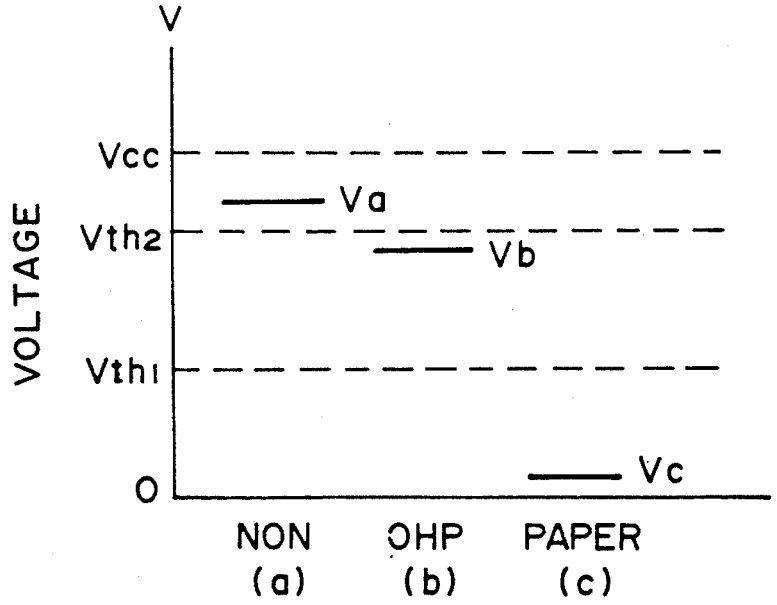
FIG. 13 is a diagram showing an output of the sensor shown in FIG. 12.

When there is no recording medium 105, the light emitting from the LED 111 is not reflected, and therefore, the phototransistor 112 does not receive light, since the surface of the platen roller 101 is black. Therefore, the potential difference Va is close to Vcc, more particularly, the level (a) shown in FIG. 13. When normal white paper is set on the platen roller 101, the potential difference Vc of the phototransistor 112 is close to 0 V, more particularly, to the level indicated by (c) in FIG. 13. When an OHP transparent sheet is on the platen roller 101, the potential difference Vb is between the above levels, more particularly, the level (b) of FIG. 13. The resistance of the resistor R and the threshold voltage levels Vth1 and Vth2 are selected in the manner described above.

Thus, on the basis of the outputs Vx and Vy, the discrimination can be made among "no recording material" (a), "OHP sheet" (b) and "white paper" (c) on the platen roller 101.

Figure 14:
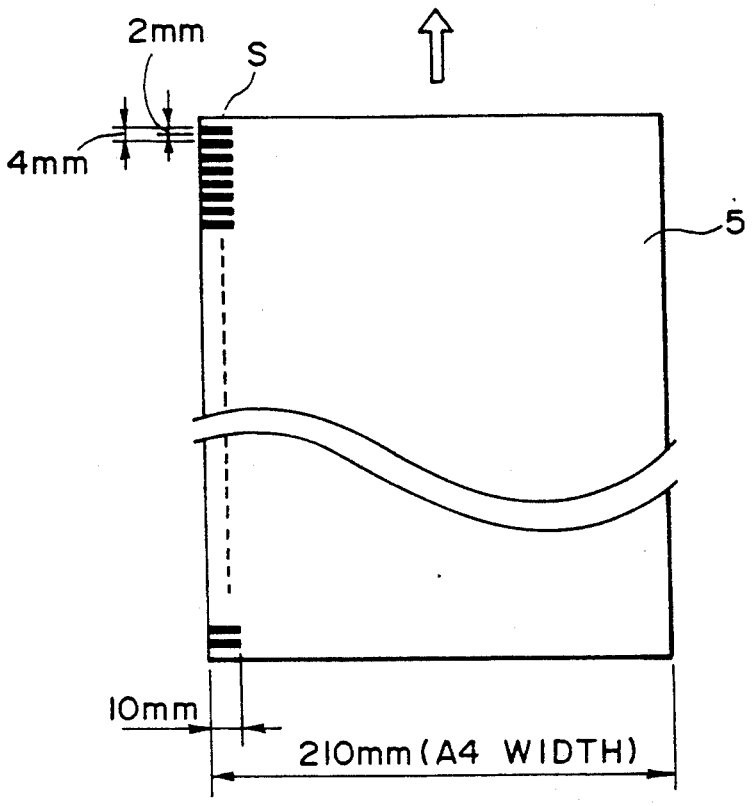
FIG. 14 is a top plan view of a marking on an OHP film, according to a further embodiment of the present invention.

FIG. 14 is a top plan view of a recording medium in a third embodiment. As shown in this Figure, the OHP sheet 105 is provided with black marks having a length of 2 mm at the pitch of 4 mm for reflecting light to a detector portion S having a width of 10 mm corresponding to the transparent type sensor 110, for the purpose of discriminating a sheet of OHP material cut into a predetermined size as the recording medium. By doing so, the comparators A and B shown in FIGS. 9 and 11 may be omitted.

Figure 15:
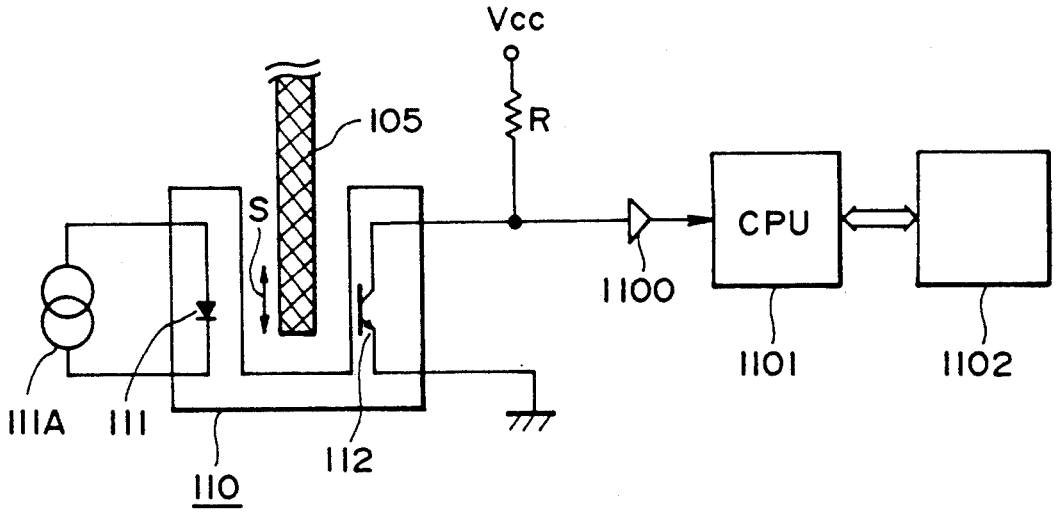
FIG. 15 is a circuit diagram of a transparent type sensor and a detecting circuit when the film with the marking of FIG. 14 is used.

More particularly, as shown in FIG. 15, a logic gate 1100 having a C-MOS structure is provided to produce "H" or "L" level signals to the CPU 1101 of the main assembly of the recording apparatus, and the potential difference in the photosensor 112 is supplied to the input side of the logic gate 1100. In this Figure, reference numeral 1102 designates an input and output block for other than the paper sensor. In this case, the potential difference Vc of the phototransistor 112 is close to 5 [V] when there is the OHP sheet or print paper, and it is close to 0 [V] when there is no recording medium. In addition, the resistance of the resistor R is set such that the logic gate 1100 has C-MOSIC outputs "H" or "L". More particularly, the gate 1100 outputs "L" when the input voltage is not more than 1.5 V, and outputs "H" when it is not less than 3.5 V.

Figure 16A:
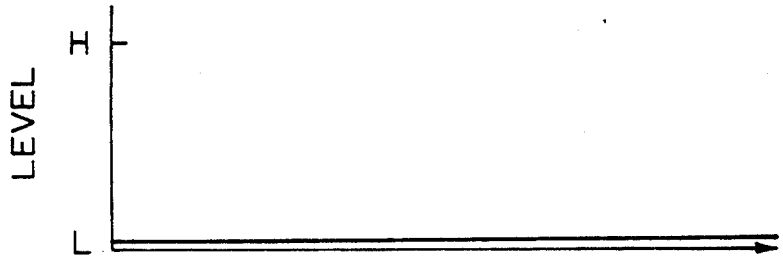
FIGS. 16(*a*)–16(*c*) are diagrams showing an output of the sensor of FIG. 15 for no recording material, OHP film and plain paper respectively.
Figure 16B:
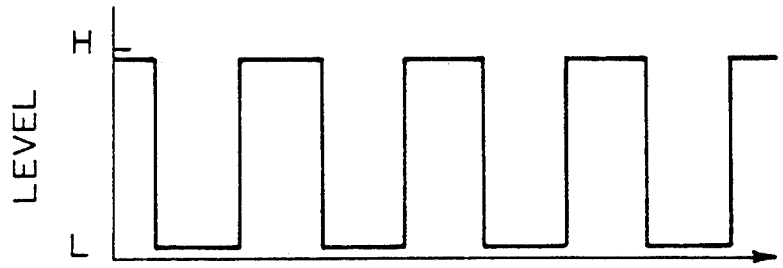
Figure 16C:
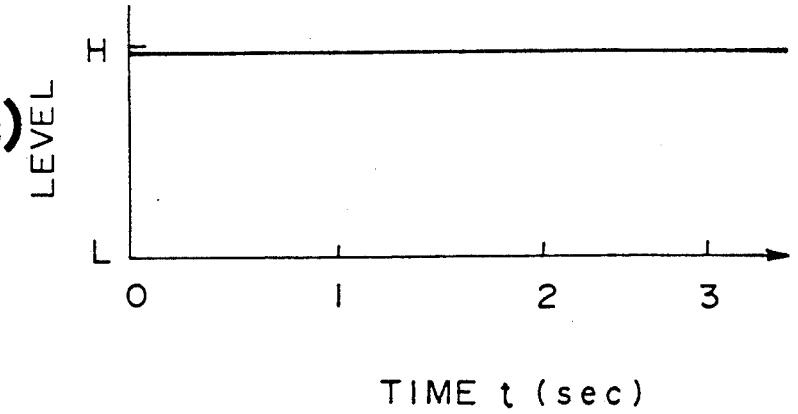

In this embodiment, the discrimination whether the recording medium is the OHP sheet or the usual white paper is carried out by the CPU 101 detecting the output of the C-MOS gate 100 in synchronization with driving of an unshown stepping motor for driving the platen roller 101 when the recording medium is fed. As shown in FIGS. 16(*a*)–16(*c*), when the potential difference V across the photosensor 12 is always "L", "no recording medium" (a) is discriminated; when the potential difference V is always "H", "presence of the white paper" (c) is discriminated; and when "H" and "L" are alternately detected, the OHP sheet is discriminated.

Since the pitch of the mark on the OHP is approximately 4 mm, the potential difference detection of the photosensor 112 in synchronization with the interval of 0.15 mm of the stepwise sheet feeding can be effected without error, thus detecting the OHP sheet assuredly. In this embodiment, the presence of the OHP sheet is discriminated when not less than three periods of alternating "H" and "L" signals are detected, and the erroneous operation attributable to the noise can be avoided. The three period detection is completed with 12 mm feeding of the recording sheet, that is, in approximately 3 sec. In order to reduce the detecting period, the pitch of the mark may be reduced. Experimentally, the detection was possible with 0.05 mm pitch.

With the foregoing structure, the transparent type sensor 110 is used, but the similar discrimination is possible using a reflection type sensor 120.

In the foregoing explanation, the OHP recording medium has been a cut sheet, but it may be in the form of a rolled OHP recording medium, and in that case, the similar detection is possible.

The foregoing discriminating means is particularly effective when the reflection characteristics and/or the transmissivity characteristics of the OHP film is similar to the characteristics without any recording material, as compared with the earlier described two embodiments. Since in that case, the mark of the OHP sheet has the reflecting or transmissivity characteristics of normal recording paper, the sensing is assured.

Figure 17:
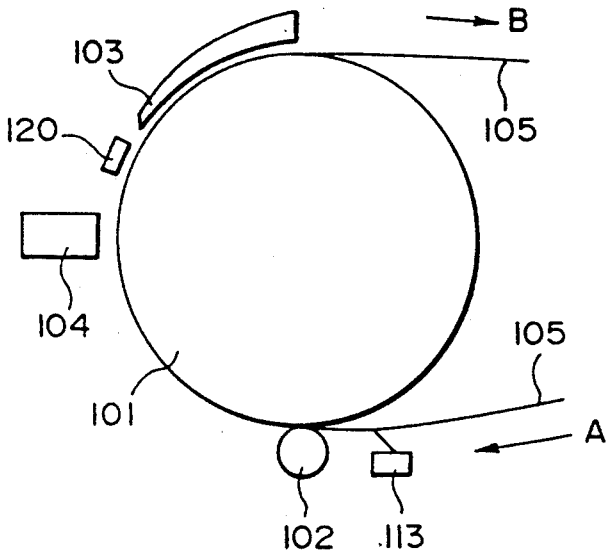
FIG. 17 is a side view of a recording apparatus, according to a further embodiment of the present invention.

FIG. 17 is a side view of a recording apparatus equipped with a mechanical sensor for the purpose of improving the reliability of the recording apparatus In the foregoing embodiments, the description has been made with respect to the case wherein the presence, absence and/or the material of the recording sheet 105 is discriminated only at the upstream side of the recording head 104 with respect to the conveyance direction of the recording sheet. The reliability of the apparatus is improved by discriminating the recording sheet 105 both at the upstream side and the downstream side of the recording head 104, for the purpose of further assuring the recording on the sheet. More particularly, in this example, a sensor 113 comprising a limit switch or the like for detecting the presence or absence of the recording sheet 105 is disposed upstream of the recording head, and a reflection type sensor 120 for discriminating the presence or absence and the material of the recording sheet 105 is disposed downstream of the recording head 104. In the conventional method, two sensors for discriminating the presence or absence and the material of the paper have been required downstream of the recording head 104. However, one sensor is enough in this embodiment.

In the foregoing embodiment, the discrimination of the recording sheet has been described with respect to the ink jet recording type system, but it is similarly applicable to the discrimination of the recording sheet in a thermal recording system.

By using the system of this example, one discriminating means is enough to discriminate the presence, absence and the material of the recording medium.

By doing so, the erroneous discrimination involved by the conventional discriminating means can be avoided. In addition, the necessity for the additional means for detecting the presence or absence of the recording medium can be removed. Therefore, the structure of the apparatus is simplified, and an inexpensive and reliable recording apparatus can be provided.

The operation of this embodiment will be described. Upon actuation of the switches 21, the recording operation is started. When the sheet sensor 9 detects the presence of the recording material 15 at the sheet feeding side of the platen 4, the line feed motor 7 stepwisely operates to rotate the platen 4, and the recording medium 15 is set at the record starting position. Then, the carriage motor 8 reciprocates the recording head 2 at a controlled speed. At this time, the laser beam is projected onto the recording medium 15 from the laser source 18. The laser beam reflected is detected by the photosensor 17. From the logic levels of the detection signals Vx and Vy shown in Table 1, it is confirmed that the recording medium 15 is at a proper position on the platen 4, and the discrimination is made as to whether the recording medium 15 is the film or the white plain paper.

When the recording medium 15 is plain paper, it is liable to be deteriorated by the application of strong laser light. Therefore, the application of the laser beam is not effected, and the line feed motor 7 feeds the recording medium 15 one line by one line in synchronization with the carriage motor 8. During this, the signal in accordance with the data 26 to be recorded is applied to the reciprocating recording head 2 from the head driver, in response to which the ink droplets are ejected through the discharge openings 5 of the recording head 2, such that characters and/or images are recorded.

When the recording medium 15 is film, the laser beam is projected in the following manner together with the recording operation on the abovedescribed plain paper.

The points A and B of time shown in FIGS. 18(*a*) and 18(*b*) show the correspondence between the position of the center line 32 between the laser sources 18 and 19 and the projections by the laser sources 18 and 19. At the points A and B, when the level is "H", the laser is projected, but when the level is "L", it is not projected.

For example, when the recording head is in the process of movement in the direction F, and when the laser source 18 is in the recording region 31, the laser source 18 emits the laser beam; and when the recording head 2 is in the process of movement in the direction R indicated by the arrow, and when the laser source 19 is on the recording region 31, the laser source 19 projects the laser beam. By projecting it in this manner, the laser source 18 or 19 emitting the laser beam is in the front side of the discharge openings 5 with respect to the recording direction irrespective of whether the recording head 2 moves in one direction or not, and therefore, the region 31 which is going to be subjected to the recording operation is given and is heated by the laser beam.

When the relation between the moving direction of the recording head and the laser sources 18 or 19 is reversed, the laser source 18 or 19 is placed behind the discharge opening 5 with respect to the recording direction, and therefore, the region 31 which has immediately been subjected to the recording operation is given and is heated by the laser beam.

When the laser beam is projected when the laser source 18 or 19 is in the recording region 31 irrespective of whether the recording head 2 is moved in the direction F or the opposite direction R, the laser sources 18 and 19 emitting the laser beams are in front of and at the behind of the discharge opening 5, and therefore, the recording region 31 is given by and heated by the laser beam before and after the recording.

The heating prior to and/or after the recording operation is selectable by operating the switches 21 instructing the CPU 120.

Good results of recording have been confirmed without blot, smear or the like, when the laser beam is projected to the recording region 31 both prior to and after the ink deposition on a transparent OHP film used as the recording medium 115, so that the projection prior to the recording removes the water contained in the film, and that the drying is promoted by the projection after the deposition.

Figure 19:
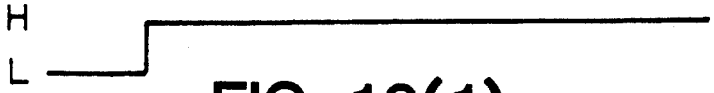
FIGS. 19(1) 19(3) are a timing charts wherein the amount of laser light is changed.
Figure 19:
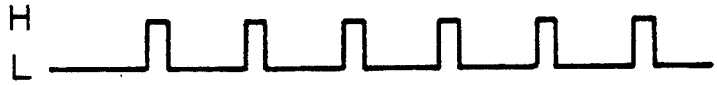
Figure 19:
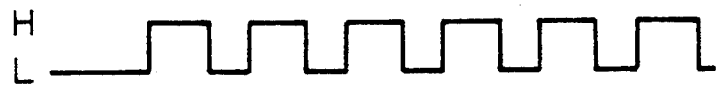

In the foregoing embodiment, the laser beam is not projected when the recording medium 15 is plain paper, but only when it is the film, the laser beam having a predetermined strength is continuously applied on the recording region 31, as shown in FIG. 19 (1). However, by projecting a smaller amount of the laser beam on the recording medium when it is plain paper, it can be dried without the liability of the deterioration of the recording medium 15.

In order to project a smaller amount of laser beam, the strength of the laser beam can be controlled. Alternatively, it may be intermittently applied in this manner. In synchronism with the timing shown in FIG. 19 (2) projecting one droplet of the ink, the laser beam having the strength which is the same as with the film but with the duty ratio which is 60% thereof, as shown in FIG. 19 (3), on the plain paper, has resulted in the recording of characters and images with high quality with less blot than when it is not projected. The duty ratio of the laser is not limited to the described above, but may be selected by one skilled in the art in accordance with the material of the sheet or the like.

In addition, the laser beam may be applied simultaneously with the deposition of the ink droplet to the ink deposition position.

Figure 20:
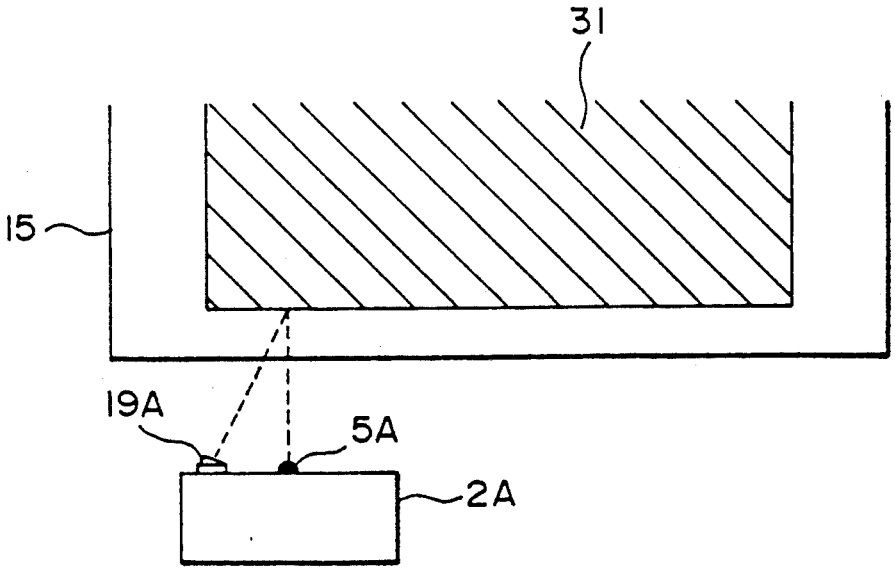
FIG. 20 is a schematic view of a major part of an ink jet recording apparatus according to a further embodiment of the present invention.

In a further embodiment shown in FIG. 20, the laser source 19A of the ink jet recording apparatus is disposed to project the laser beam onto the position where the ink droplet is deposited from the discharge opening 5A of the recording head. The laser source 19A projects the laser beam simultaneously with the deposition of the ink droplet on the recording medium 15.

Where the recording head has plural discharge openings, the laser beam can be projected to the plural positions simultaneously with the deposition of the ink droplets by using plural laser sources 19A, similarly to the foregoing embodiment.

In order to improve the fixing property, the following structure may be added. In this structure, the fixing properties can be improved without decreasing the printing speed, and is particularly effective when used with the fixing by the laser beam.

Figure 21:
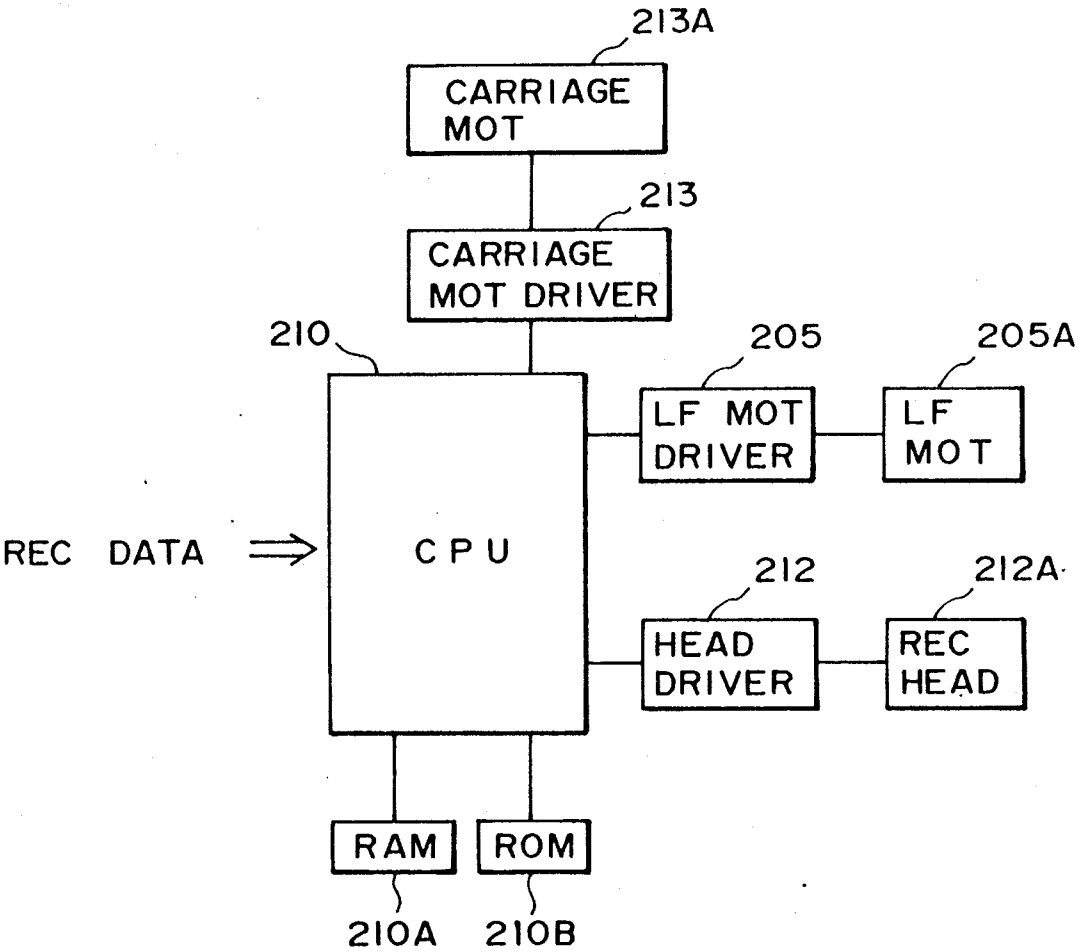
FIG. 21 is a block diagram of a control system for an ink jet recording apparatus according to a further embodiment of the present invention.

In FIG. 21 showing this embodiment, a block diagram is shown for the control of the ink jet recording apparatus. The control system comprises a CPU 210 for executing signal processing and drive control operations for the ink jet recording apparatus in accordance with the recording data or the control signal from a host machines or the like, RAM 210A functioning as a work area in the processing and the control and ROM 210B for storing the control process or the like shown in FIGS. 22 and 26.

Reference numeral 205 designates an LF motor driver for driving an LF motor 205A for the paper feeding; 212, a head driver for driving the recording head 212A; and 213, a carriage motor driver for driving the carriage 213A for moving the carriage carrying the recording head 212A.

Figure 22:
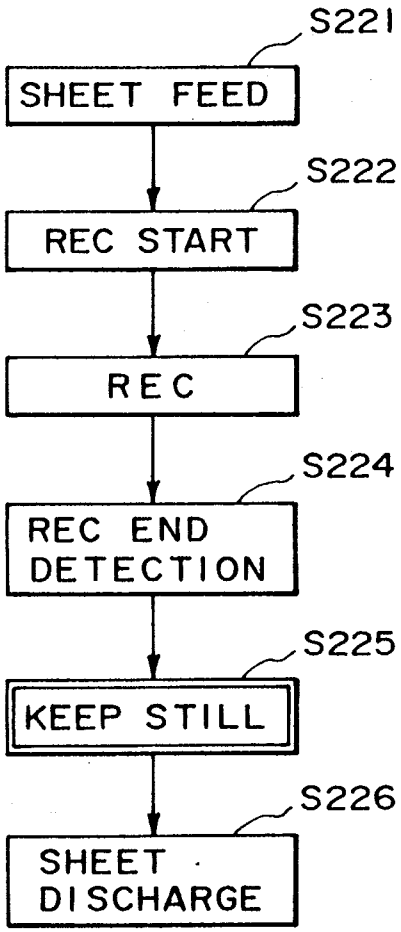
FIG. 22 is a flow chart for the recording operation in the apparatus of FIG. 21.

FIG. 22 is a flow chart illustrating an operation of the apparatus shown in FIG. 21. At step S221, the sheet is fed, and when the recording paper reaches the recording region faced to the recording head, the recording operation is started at step S222, and the recording operation is performed at step S223.

Next, at step S224, the completion of the recording is detected, that is, the recording of the data to be recorded on the recording paper is completed. Then, the sheet feeding is stopped at S225, and the paper is retained there for a predetermined period of time. After the predetermined period of time elapses, the paper is discharged at step S226. This is the end of the processing.

The detection of the recording operation on the recording sheet (one page when a roll of paper is used) is such that when, for example, the record data is stored in a page buffer of RAM 210A, the last data of the page (recording paper) is detected, and when the record data is supplied to the head driver 212, it is detected to detect the end of the recording.

An example will be described wherein the resting period is 15 sec.

In an ink jet recording apparatus of the above-described analog modulation type, the recording paper is rested for 15 sec after the end of the recording and thereafter, it is automatically discharged. The recording paper used was commercially available OHP film (Bex font, 2GB-724) for the ink jet recording. On this recording paper, images by mixture of magenta and cyan were formed. The resultant image had good quality without smear of unfixed ink.

Figure 23A:
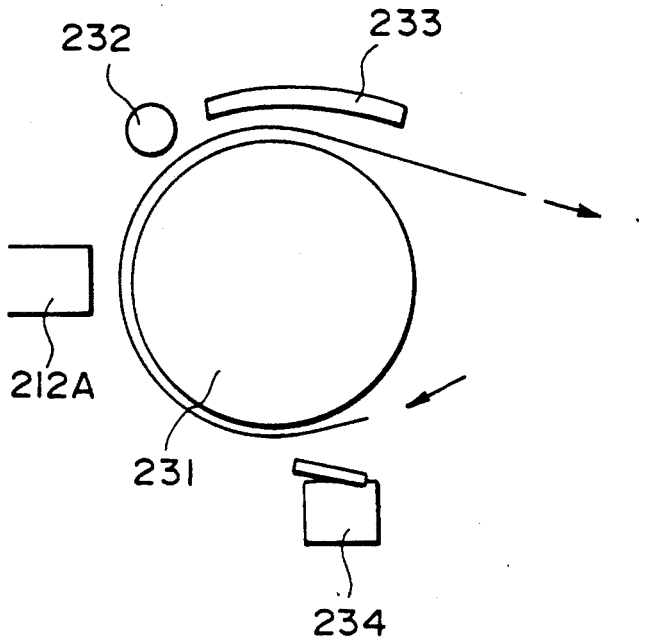
FIG. 23A and 23B are side views of an ink jet recording apparatus according to a further embodiment of the present invention.
Figure 23B:
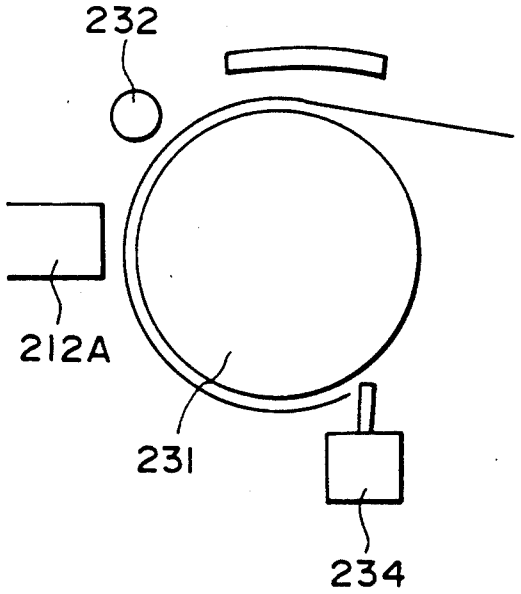

FIGS. 23A and 23B show an ink jet recording apparatus according to a further embodiment of the present invention. An example of a method for detecting a trailing edge of rolled recording paper is shown. During the recording sheet being fed, a movable portion of the mechanical paper sensor 234 is tilted (on state), as shown in FIG. 23A. After the recording paper passes through, the movable portion is erected, as shown in FIG. 23B (off state), to detect the trailing edge of the rolled recording paper.

After the trailing edge of the recording paper is detected, the recording paper is rested for 15 sec, and thereafter, it is automatically discharged, similarly to the above embodiment. By doing such a control, the trailing edge of the rolled recording paper is detected in the process of the paper discharging or the recording operation, and the paper is discharged 15 sec after the detection.

As a result, the paper guide or the like is prevented from being contaminated by ink when the paper is discharged in the case wherein the rolled paper comes to its end.

As a comparison example, a conventional recording apparatus was operated for the above-described commercially available OHP film, and the paper was discharged immediately after the end of the recording. As a result, the portion adjacent to the trailing edge of the recording paper was smeared by the paper guide because the ink was not completely absorbed there, and in addition, the paper guide was contaminated with the ink. The contamination would then contaminate the next recording paper.

As a result of many experiments and investigations by the inventors, it has been found that although the absorption speed of the ink by the OHP film described above is slightly different depending on individual films, three sec or more is enough to prevent contamination of the discharging roller or the like by the ink. If a film requiring 30 sec or more to absorb the ink is used, another problem arises that beading occurs between adjacent dots, and the recording period is increased with the deterioration of the image quality. Therefore, the resting period after the end of the recording operation is preferably 3–30 sec.

However, when the preliminary fixing operation is performed with the application of the laser beam, and then, the paper is rested during the paper discharge to fix the image, the resting period not less than 1 sec and not more than 20 sec is enough.

When the laser beam application and the resting period during the discharge are combined, the power consumption by the laser application or projection can be reduced. In addition, the resting period can be reduced, so that good image fixing operation can be accomplished without reduction of the throughput and without increasing the power consumption.

The detection of the recording paper may be of the type using the above-described laser beam or a type wherein it is optically detected.

Figure 24:
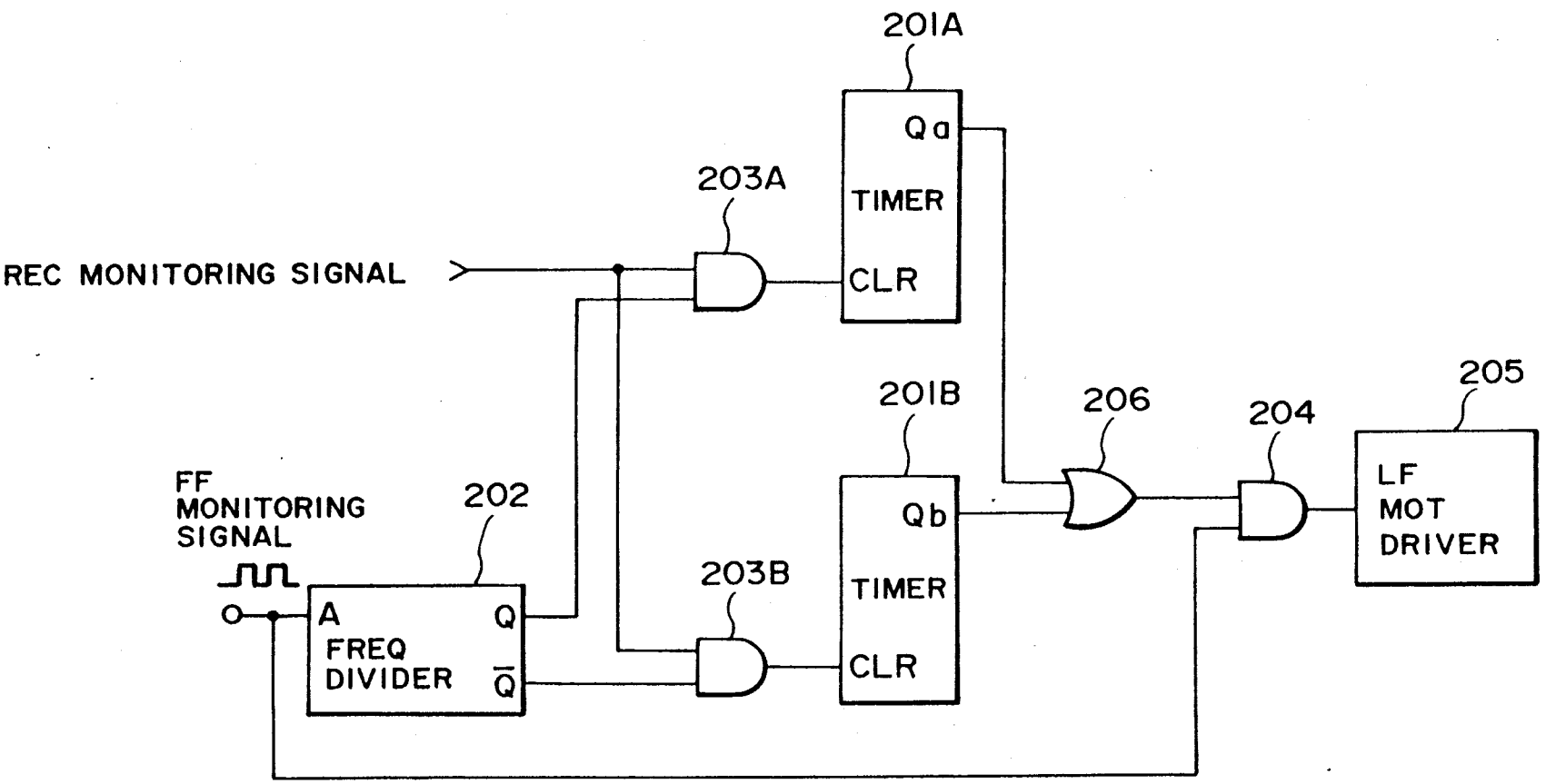
FIG. 24 is a block diagram of a control circuit, according to a further embodiment of the present invention.
Figure 25:
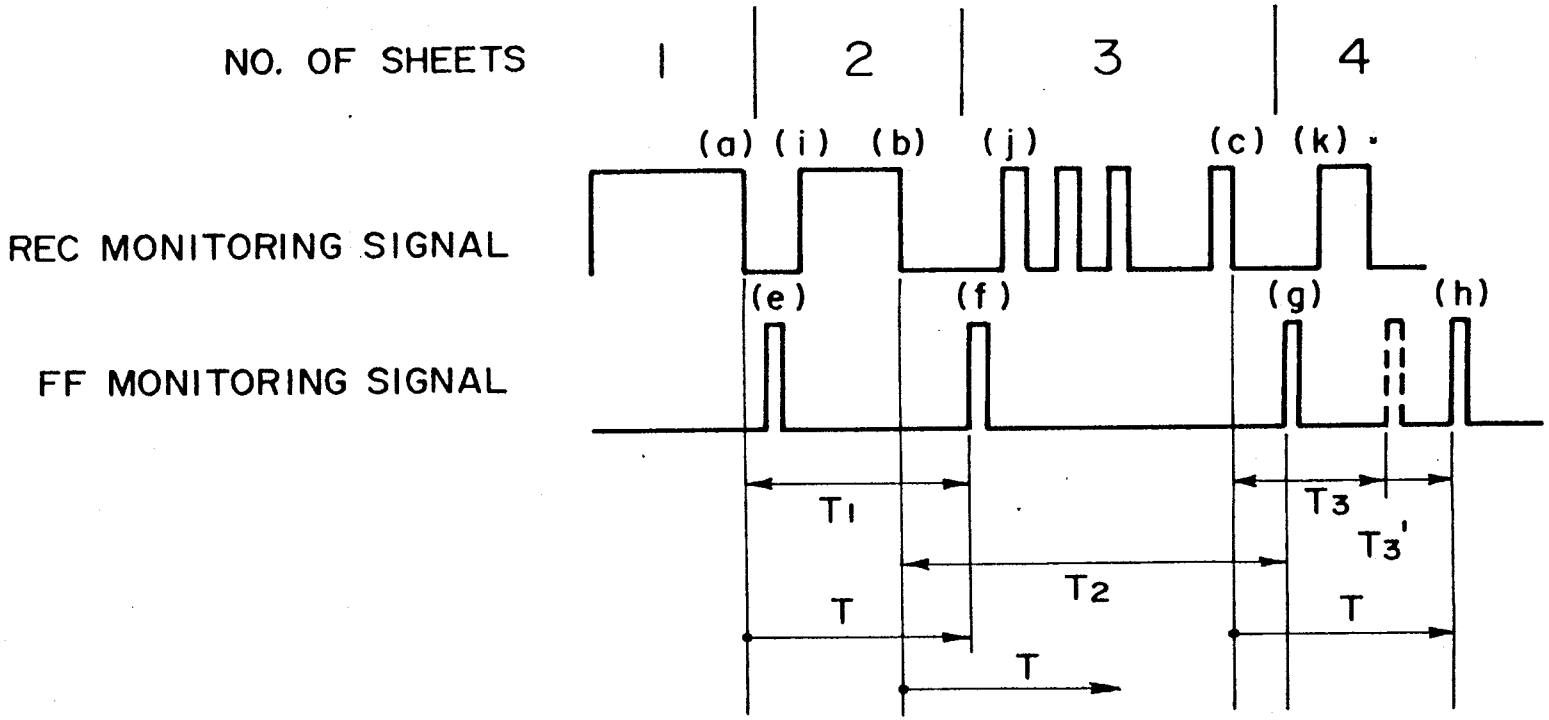
FIGS. 25 and 26 are a timing chart and a flow chart of the operation in the circuit shown in FIG. 24.

FIGS. 24 and 25 show a circuit block diagram and a timing chart therefor in an apparatus according to a further embodiment of the present invention. The circuit is connected between the CPU 210 and the LF motor driver 5 shown in FIG. 21.

It comprises, as shown in those Figures, timers 210A and 210B for measuring the time period in which the clear signal CLR is at "L" level and for rendering "H" the outputs Qa and Qb after a predetermined period of time, a frequency divider 202 for dividing by two the input FF monitor signal to produce Q and $\overline{Q}$ outputs, and AND gates 203A and 203B for receiving as one of the inputs the record monitoring signal and for receiving the other one of the inputs the Q output and $\overline{Q}$ of the frequency divider 202. It further comprises an OR gate 206 for receiving the output Qa of the timer 201A and the output Qb of the timer 201B, AND gate 204 for receiving as one of the inputs the output from the OR gate 206 and for receiving as the other one of the inputs the FF monitor signal, and LF motor driver 205 for driving the LF motor 205A for the sheet conveyance in accordance with the FF monitor signal. By driving the LF motor 205A in accordance with the FF monitor signal, the FF sheet conveyance described above is performed.

In the structure described above, the output Q of the frequency divider 202 is "H" at the initial state. Under this condition, the timers 201A and 201B are not cleared unless the recording monitor signal becomes "H", and therefore, the outputs Qa and Qb are rendered "H" after a predetermined period of time, and they are retained. If the FF monitor signal is produced corresponding to the paper discharge instructions in this period, the output of the AND gate 204 becomes "H", upon which the LF motor 5A is driven by the LF motor driver 205, so that the FF sheet feeding is performed for the paper discharge.

Upon the start of the recording operation, the record monitoring signal becomes "H", by which the AND gates 203A and 203B are opened. At this time, one of the Q or $\overline{Q}$ outputs of the frequency divider 201 is "H", and therefore, one of the timers 201A or 201B is cleared, so that one of the output Qa or the output Qb becomes "L".

Upon the end of the recording, that is, the record monitoring signal becomes "L", the outputs of the AND gates 203A and 203B, that is, the clear signals thereof become "L", by which that one of the timers which has the clear signal of "H" starts the time counting. In the counting operations of the timers 201A and 201B, when the preset period of time T elapses, the counting is stopped, and the outputs Qa and Qb are rendered "H".

Referring to FIG. 25, the time counting for the period T will be described in conjunction with the paper discharging operation.

After the end of the first sheet recording (time (a)), the timer starts it time counting operation, and the first recording sheet is discharged by the FF sheet feeding, ((e)). Simultaneously with the sheet discharge, the signal logical of the Q and $\overline{Q}$ outputs of the frequency divider 202 is reversed. Then, when the recording on the second sheet is started ((i)), the record monitoring signal becomes "H", and one of the timers 201A and 201B is cleared, and the cleared timer starts the time counting (time (b)), after the end of the recording operation.

As shown in FIG. 25, the point of time (f) at which the FF monitor signal becomes "H" to discharge the second recording sheet is equal to the point of time at which the time period T1 elapses after the end of the recording operation for the previous recording sheet. The time period is larger than the time period T required for the ink fixing, and therefore, the timer times up at the time T so as to render the output Qa or Qb "H", upon which the gate 204 is opened to permit the FF paper feeding.

As for the third recording sheet, the sheet discharging operation is similar, since the recording period T2 ($>$T) is sufficiently long. As to the fourth sheet, the recording period is short, and therefore, the time period T3 elapsed from the end of the third sheet recording is short, so that the FF monitor signal becomes "H" at the point of time indicated by broken line in the Figure. At this point of time, $T3<T$, and therefore, the outputs of both of the timers are "L", and therefore, the execution of the FF sheet feeding is limited by the closure of the AND gate 204. By this, it is rested until the sufficient fixing period elapsed. When $T3' \geqq T$ is satisfied, the FF instructions become valid to permit output of the FF monitor signal through the AND gate 204, upon which the driver 205 is operated.

Here, the time period T required for the fixing is set so as to sufficiently fix the record. The recording monitoring signal can be taken out from heating signals in a bubble jet printer or in a thermal ink jet printer wherein the recording head producing droplets of the recording liquid by thermal energy applied to the recording liquid. In addition, the FF monitor signal can be easily taken out and is prevented from interference with normal line sheet feeding.

In the timing chart of FIG. 25, the time counting by the timer is started each time the record monitoring signal becomes "L" for the third recording sheet, but it is omitted for simplicity.

Figure 26:
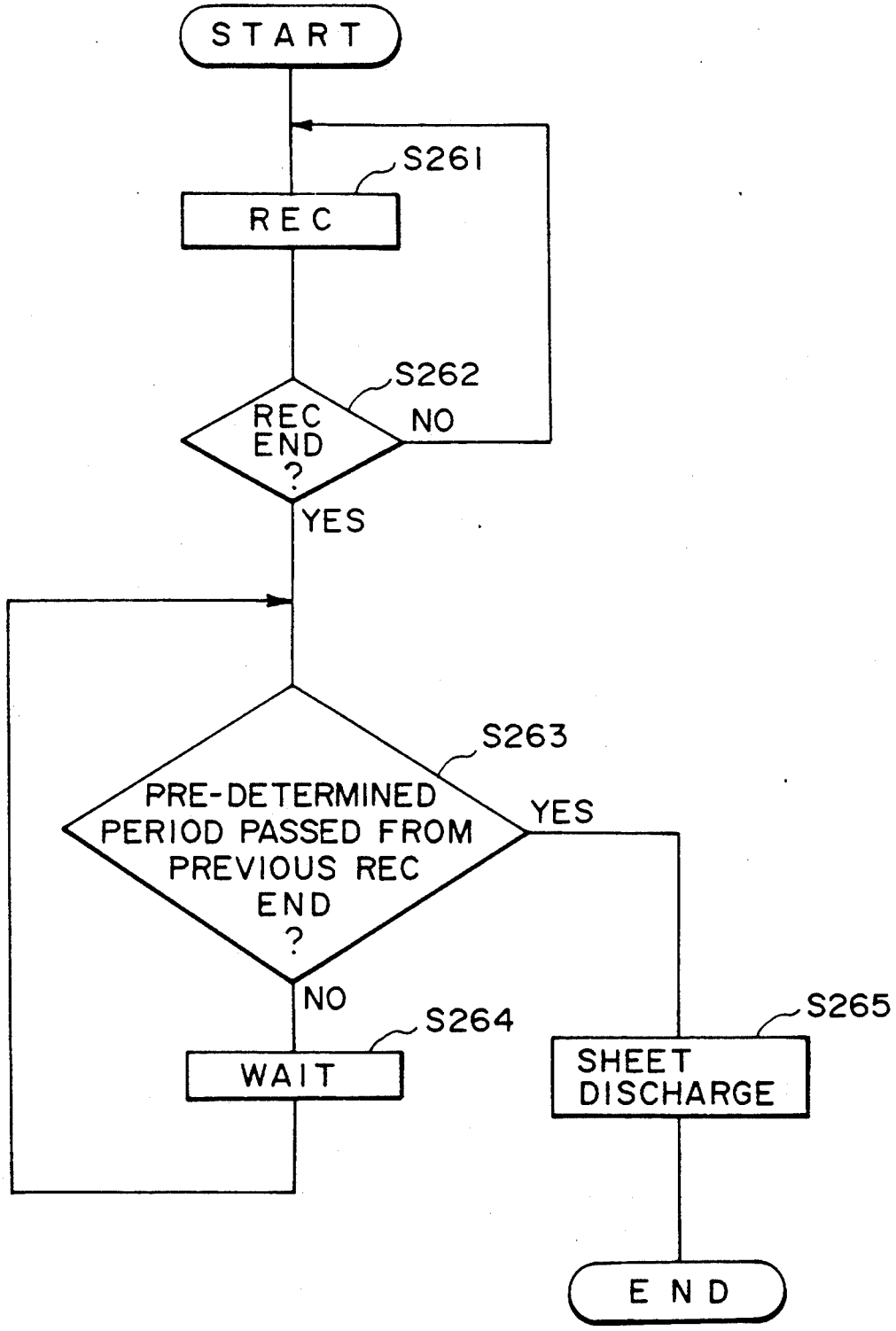

FIG. 26 is a flow chart illustrating the time counting operation in connection with the recording and paper discharging operations shown in FIGS. 24 and 25. By the operation shown in this Figure, one recording sheet is subjected to the recording and discharging operation.

Figure 27:
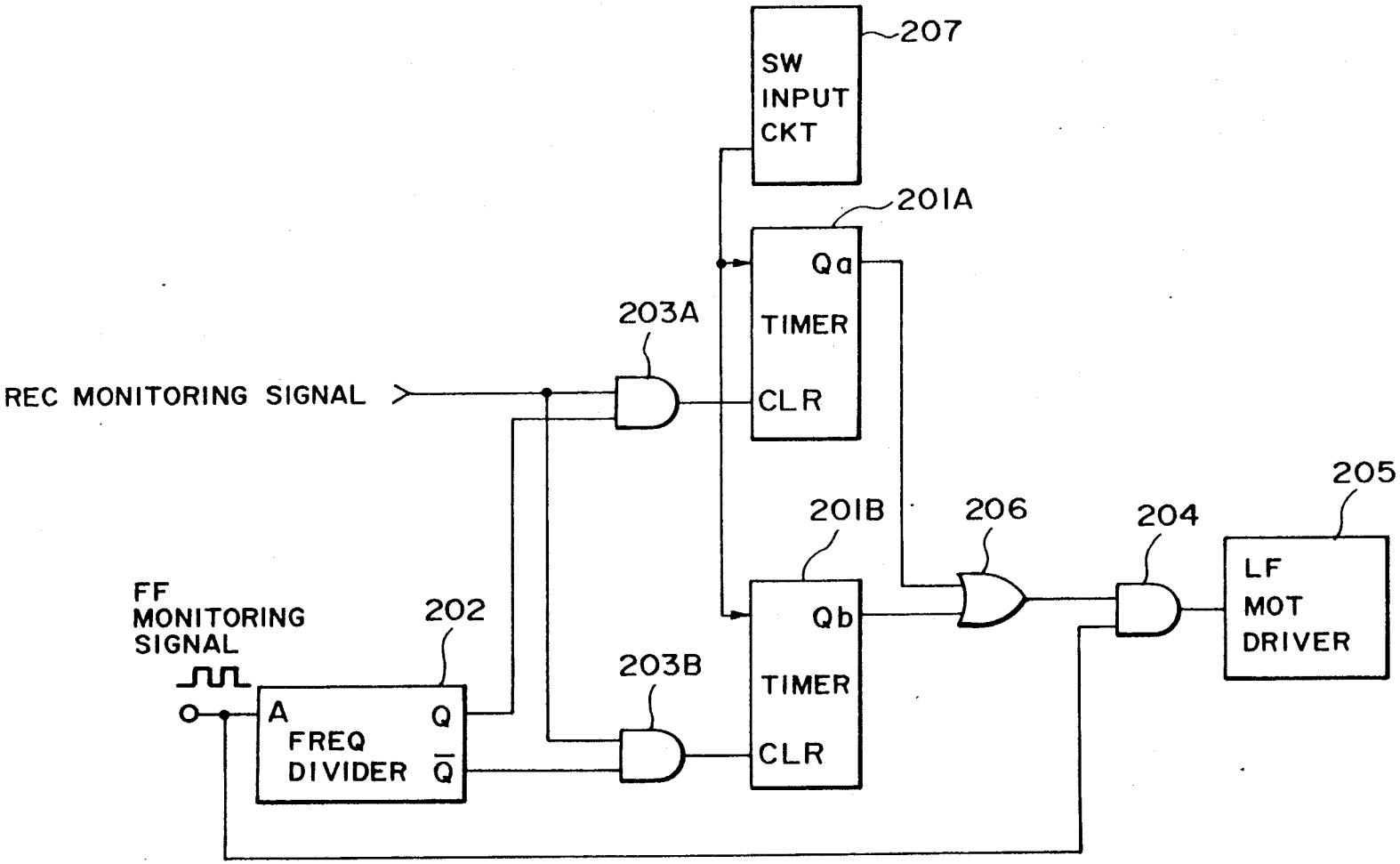
FIG. 27 is a block diagram of a control circuit according to a further embodiment of the present invention.

FIG. 27 is a circuit block diagram of a control circuit for an apparatus according to a further embodiment. In this Figure, the same reference numerals as in FIG. 24 are assigned to the elements having the corresponding functions, and the detailed explanation thereof is omitted for simplicity. In this Figure, reference numeral 207 designates switch input circuit for setting the fixing time period which changes depending on the material of the recording paper.

With this structure, when the recording operation is effected onto the recording mediums having different fixing times, the time period sufficient for the fixing is set for each of the recording sheets by the switch input circuit 207. The switch input circuit 207 may be replaced with a sensor for detecting the material or kind of the recording mediums. In this case, the same operation is possible.

Figure 1:
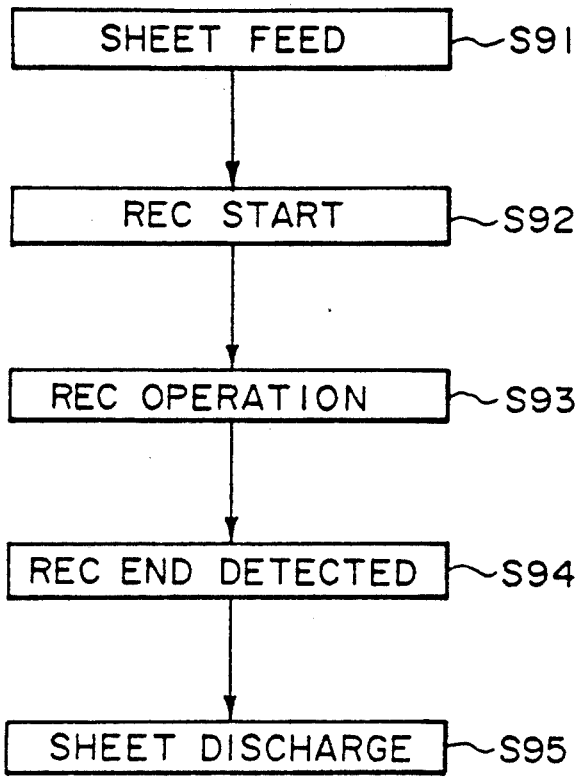
FIG. 1 PRIOR ART
FIG. 1 is a flow chart illustrating the operation of a conventional example of the ink jet recording apparatus.
Figure 2:
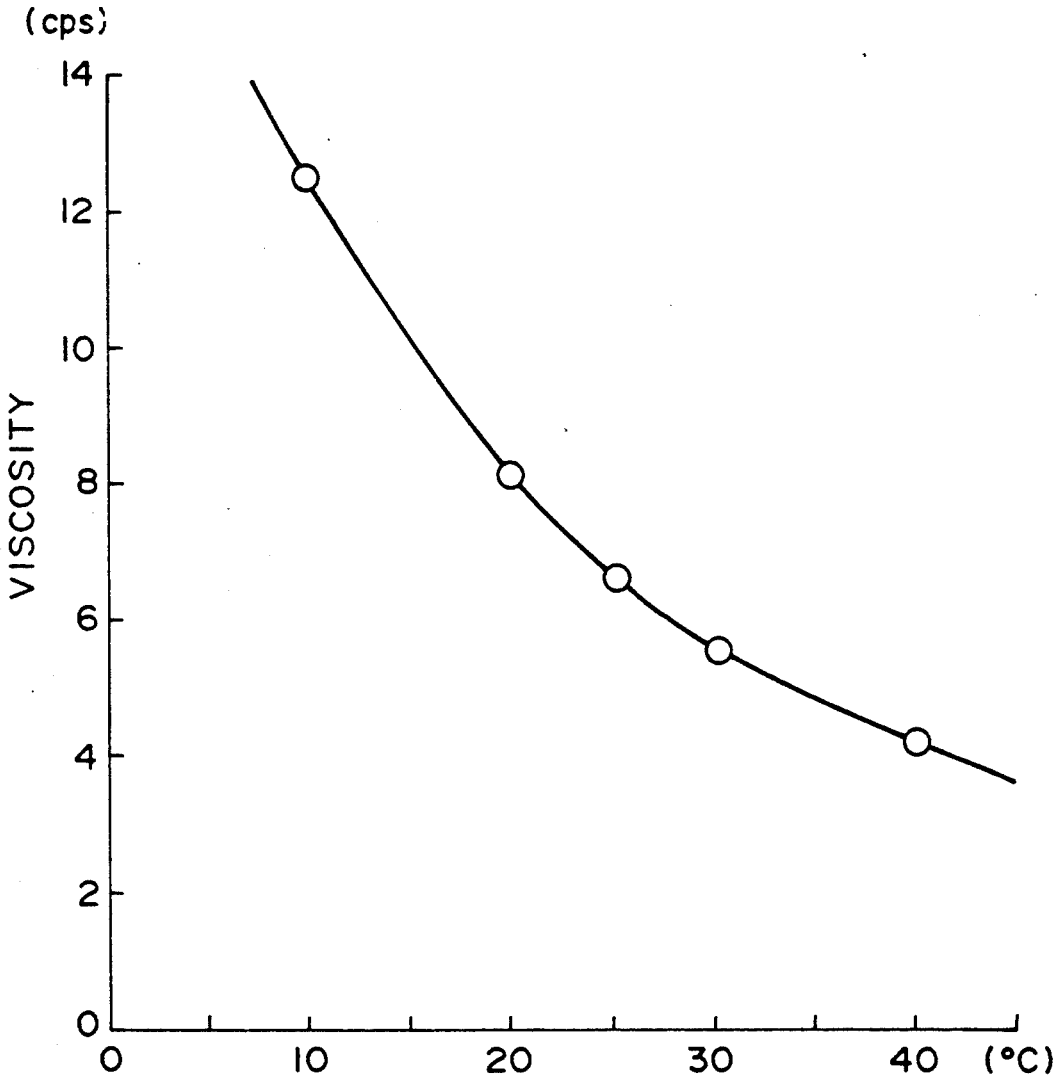
FIG. 2 is a graph showing the relation between the ink temperature and the ink viscosity.

By the structure described above, the fixing of the ink deposited on the recording medium can be sufficiently improved. In addition, by controlling the recording operation, the fixing can be further improved. More particularly, the degree of the record fixing is different depending on the ambient conditions, particularly the temperature, and the state of the ejected ink also changes. This has been described in conjunction with FIG. 2. The ejecting operation is performed in consideration of the viscosity of the ink, the degree of the fixing is further improved.

The recording operation, more particularly, the ink ejection, may be positively changed depending on the materials of the recording medium on which the recording operation is performed, for example, depending on whether it is plain paper on which the ink is relatively easily fixed or an OHP recording medium on which the ink is not easily fixed.

The description will be made particularly as to a piezoelectric element type ink jet recording head using piezoelectric elements. However, the following is applicable to the bubble jet type apparatus using the thermal energy as the liquid ejecting energy in consideration of the fact that the control is effected by changing the driving voltage.

Prior to the description of the present invention, the ejecting principle of the recording head using the piezoelectric elements will be described.

Figure 28:
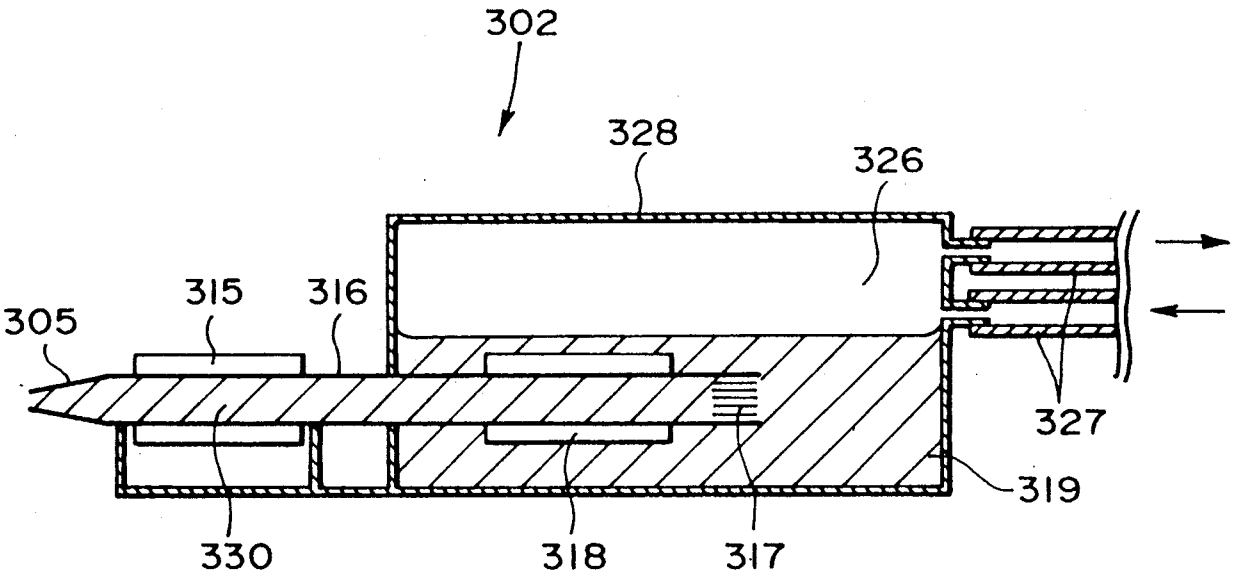
FIG. 28 is a sectional view of a mechanical structure of the recording head, according to a further embodiment of the present invention.

FIG. 28 shows the mechanical structure of the recording head according to one embodiment of the present invention. The glass pipe 316 is converged at the ink ejecting end to form a nozzle 305.

To the outer periphery at the ends of the glass pipe 316, a piezoelectric actuator 315 made of piezoelectric element formed into a cylindrical form is mounted. By applying a voltage to the piezoelectric actuator 315, a pressure chamber 330 containing the recording liquid is contracted or expanded to eject the ink liquid. To the back side end of the glass pipe 316, a rubber tube 318 is mounted to suppress the mechanical vibration of the glass pipe 316, and is further provided with a filter 317 to prevent foreign matter in the ink 319 from entering the pressure chamber 330.

A part of the glass pipe 316 with the abovedescribed parts is inserted into an ink subordinate tank 328. The ink supplied from an ink main tank not shown below the subordinate tank 328 through a tube 327 is ejected through the nozzle 305. Above the liquid surface in the subordinate tank 328, there is air.

Figure 29A:
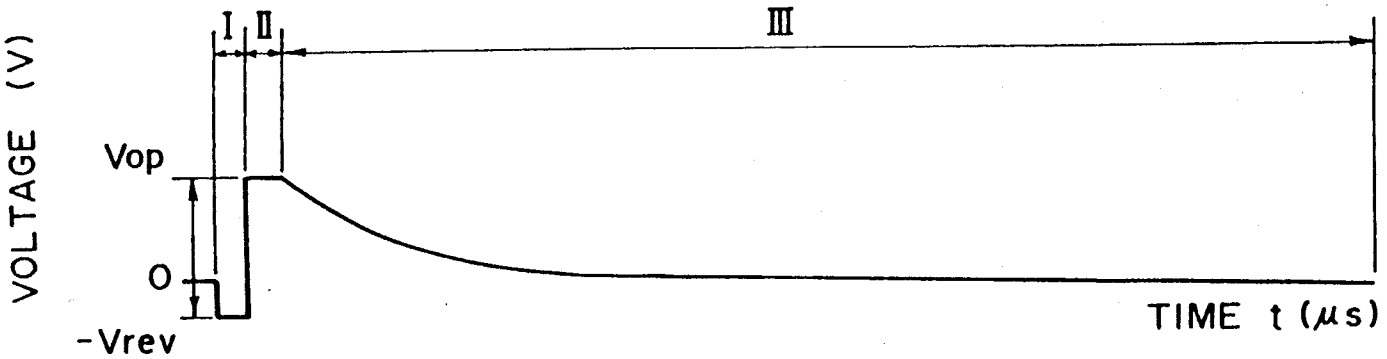
FIGS. 29(A) and (29)(B) illustrates the relationship between the voltage applied and the position of the meniscus in an apparatus according to an embodiment of the present invention.

To the piezoelectric actuator 315 of the recording head 302 having the structure described above, energy (voltage in this embodiment) is applied which has the waveform shown in FIG. 29A. In FIG. 29A, the region I, the pressure chamber 330 is expanded; in the region II, the pressure chamber 330 is contracted; and in the region III, the pressure chamber 330 is returned to the initial state.

In the region I, the piezoelectric actuator 315 is supplied with a negative voltage Vrev by the head driver 324 for T1 period to expand the pressure chamber 330.

In the region II, the piezoelectric actuator 315 is supplied with a positive voltage Vop for T2 period to contract the pressure chamber 330. At this time, a droplet of the ink is formed and is ejected toward the recording sheet surface.

In the region III, the electric discharge occurs due to the electrostatic capacity of the piezoelectric actuator and the discharge resistance of the head driver 324, and the pressure chamber 330 is recovered to the initial state with the exponential curve property.

Figure 29B:
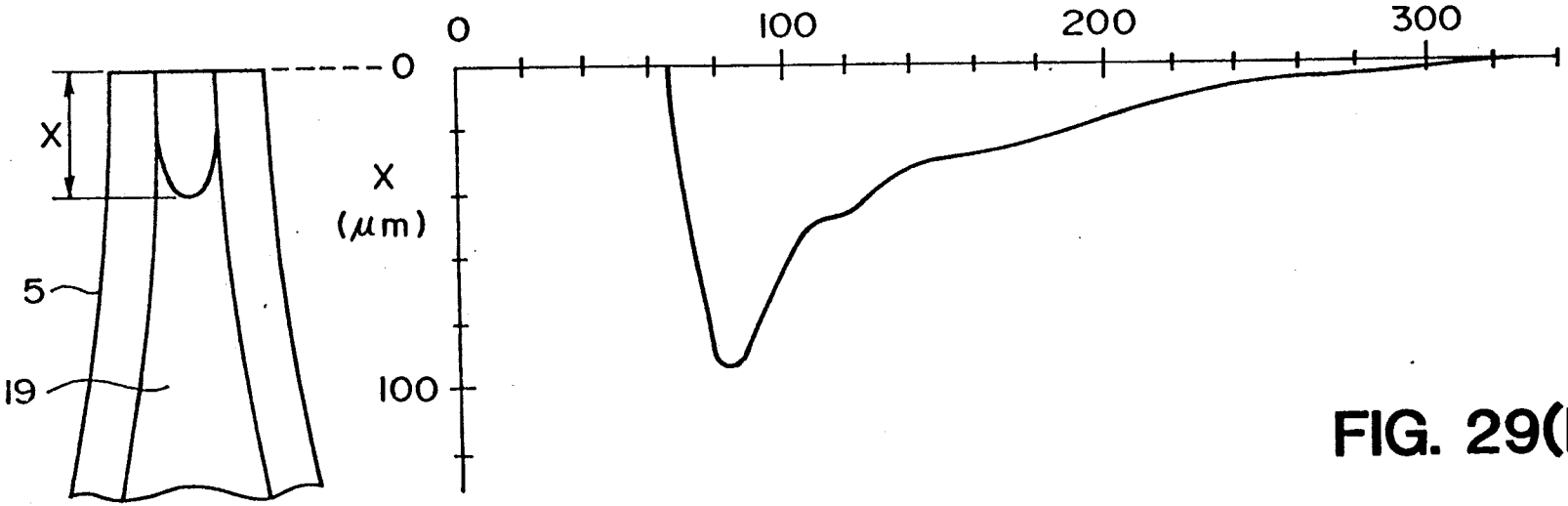

The relationship between the time t and the retraction amount of the meniscus which is the interface between the ink 319 and the ambience, more particularly, the retraction amount x of the meniscus from the end of the nozzle at the time of the ink ejection, is as shown in FIG. 29B, wherein $x=0$ (microns) around $t=300$ ($\mu$sec), at this time, the recovery step III has ended, and therefore, the recording frequency of the recording head having such a property is approximately 300 $\mu$sec.

FIG. 30B shows the relationship between the time t and the meniscus retraction amount x with the parameter of the temperature when the pressure chamber 330 expands. At this time, the constant level waveform shown in FIG. 30A (Vrev) is stepwisely applied to the piezoelectric actuator 315. In response thereto, the meniscus retracts to the pressure chamber 330 side by the pressure change in the pressure chamber 330.

In this Figure, when the temperature of the ink is 25° C., the peak of the retraction is $x_{25}$ nearly equal 10 (microns) at the time $t_{25}=10$ ($\mu$sec); when the temperature of the ink is 40° C., the retraction amount $x_{40}$ nearly equal 12 (microns) at time $t_{40}$ near equal 7 ($\mu$sec); and when the temperature of the ink is 10° C., the retraction amount $x_{10}$ nearly equal 8 (microns) at the time $t_{10}$ nearly equal 14 ($\mu$sec). The peak changes in this manner.

The inventors have found that the amount of ink ejection significantly changes when the retraction position of the meniscus changes in accordance with the change in the ink temperature. In this embodiment, this property is utilized. More particularly, by the change (not performed in the conventional apparatus) of the level or the application period of the negative voltage Vrev applied to the piezoelectric actuator 315, the position of the meniscus when the expansion of the pressure chamber 330 immediately before the ink ejection is changed in accordance with the temperature to provide the stabilized ink ejection.

Referring back to FIG. 3, there is shown a mechanical structure of the major parts of the ink jet printer according to an embodiment of the present invention. The control of the ink jet printer is performed by a known CPU 20 (central processing unit) with the structure of the control system shown in FIG. 5. The CPU 20 performs the following controlling operation in accordance with the actuation of the switches 21 on an unshown operating panel.

It refers to the digital input from the encoder sensor 13 and the home position sensor 11, and drives the carriage motor 308 through the DC servo reversing circuit 22 to control the movement of the recording head 2 in the main scanning direction.

Through the stepping motor driving circuit 23, the driving of the line feed motor 7 is controlled.

Furthermore, the record data 4 transferred from an external control system such as a computer or the like are supplied to the head driver 24, and the ink droplets are ejected onto the recording paper from the recording head 2. The control is such that whether the ink droplet is to be ejected or not and the size of the ink droplet are controlled for each of the droplets in a drop-on-demand system.

For the purpose of this control, the CPU 20 has a read only memory containing a table determining, for all temperatures and for all recording densities, the magnitude of the applied energy when the pressure chamber 330 (FIG. 28) is expanded, more particularly, the level and time period of the applied pulse and the level and the time period of the applied pulse when the pressure chamber 330 is contracted.

The CPU 20 controls the other mechanisms (not shown) in accordance with the input from the sensors 25.

In this structure, when the print switch in the switch group 21 is depressed, the recording operation is started. First, the presence of the recording sheet is confirmed by the sheet sensor 9, and the line feed motor 7 is stepwisely driven by several steps, and the platen 1 is rotated. Then, the recording sheet is set at the record starting position.

Then, the carriage motor 8 reciprocates the recording head 2 in the main scan direction at a controlled constant speed. In synchronism with the reciprocating movement, the line feed motor 7 is driven to feed the recording paper one line by one line. During this, the head driver 24 supplies the signals corresponding to the record data 4 to the recording head 2, and the ink droplet is ejected from the nozzle 5 of the recording head to record characters and images.

Figure 31:
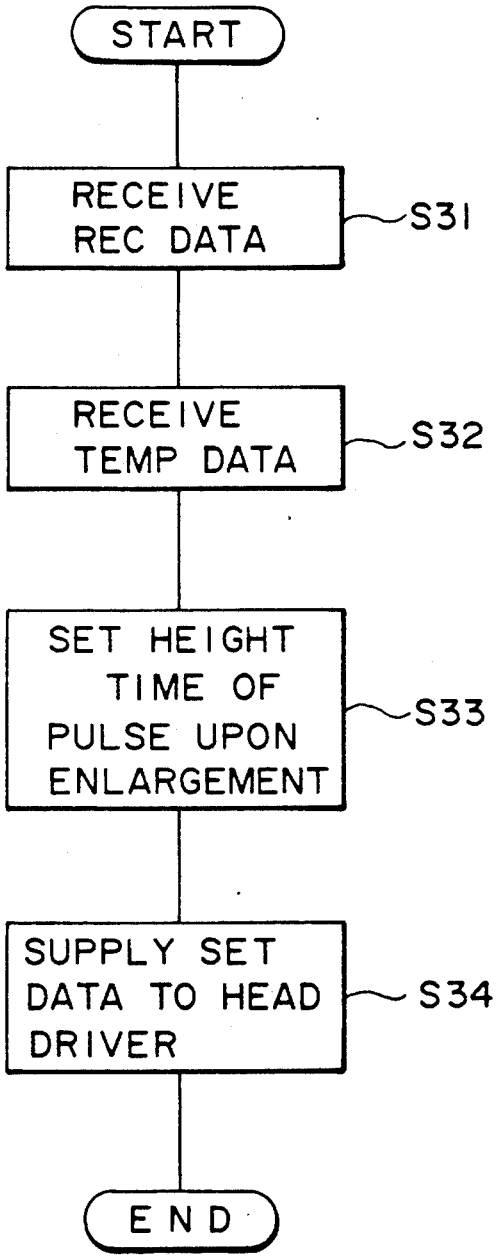
FIG. 31 is a flow chart illustrating the control steps executed by a CPU 20 in an apparatus according to an embodiment of the present invention.

FIG. 31 shows the control steps for the temperature correction of the ejection ink performed by the CPU 20 of FIG. 5.

In FIG. 31, when the record data is received from the external system, the record data is stored in the buffer memory (not shown) by the CPU 20 (step S31).

Next, the temperature data of the ink liquid is received from the temperature sensor in the sensor group 25 at step S32. Subsequently, the CPU 20 selects an address corresponding to the image density level and the temperature datum for each of the picture elements of the record data in the internal ROM, and reads from the internal ROM the data of the energy to be applied upon the expansion of the pressure chamber 330 and the data of the energy to be applied upon contraction of the pressure chamber 330, at step S33. Then, the data are transmitted to the head driver 324 in synchronism with the dot recording.

Figure 32:
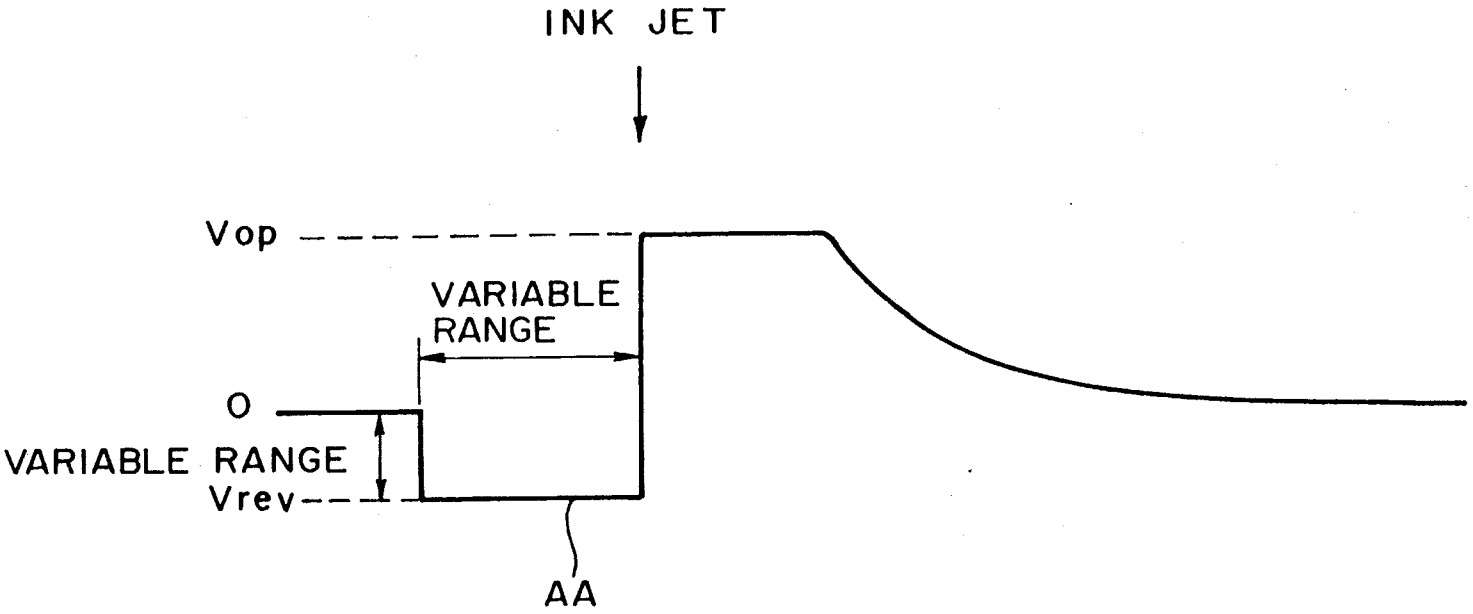
FIG. 32 shows a waveform of an applied voltage in an apparatus according to an embodiment of the present invention.

When the head driver 324 receives the energy apply data, it is applied to the piezoelectric actuator 315 after at least one of the application period and the level of the negative voltage Vrev is set variably so that it decreases with the temperature, as shown in FIG. 32. Then, a positive voltage Vop is produced on the basis of the energy application data received. As a result, even if the viscosity of the ink liquid changes in accordance with the temperature, the position of the meniscus of the ink liquid is controlled to be proper for the ink ejection, and therefore, high quality images can be produced.

Since the meniscus has a complicated configuration, it is easily deformed due to a very slight non-uniformity in the nozzle, for example, when only a part of the nozzle is low in the wetting, or when the circularity of the nozzle is low, with the result that the air enters the pressure chamber 330, and therefore, the ink ejection is not proper. This problem can be solved by controlling the meniscus position. When the positive voltage Vop (FIG. 32) is applied upon the ink ejection, it is frequent that the meniscus is displaced in the forward or backward direction. However, by controlling the position of the meniscus, it is possible to stop the meniscus position upon ejection, thus further stabilizing the ejection.

The following is modified application of the present invention.

(1) In the foregoing embodiment, the position of the meniscus is controlled by variably setting at least one of the pulse width and the pulse duration of the pressure chamber 330 expanding voltage (negative voltage). The applied energy may be changed by changing both of the pulse voltage and the pulse duration.

(2) The ink ejection quantity is determined by a sum of the energy expanding the pressure chamber 330 and the energy for contracting it. When the energy for expanding the pressure chamber 330 is changed to control the position of the meniscus, the energy for contracting it may be changed so that the total applied energy is constant, by which the amount of ink ejection is stabilized with further enhanced image quality.

In addition to the control of the ejection in accordance with the ambient temperature described above, the image may be fixed by the laser beam application or by providing the rest period at the time of the recording medium discharge, the image fixing property on the recording medium can be further improved.

More particularly, the ambient temperature is detected by a known detecting means, and the ink ejection is controlled in the manner described above. If the temperature detected is low, the power of the laser beam projection is increased, and/or the resting period is increased.

When the ambient temperature is high, the water in the ink is easily evaporated, and therefore, the control is reversed.

In addition, the ejection is changed in accordance with the material of the recording medium, and the fixing parameters may be changed in the manner described above.

The control of the ejection in accordance with the material of the recording medium may be as shown in U.S Pat. No. 4,617,580.

More particularly, in the plain paper mode, for example, the ink is relatively easily absorbed, so that a larger quantity of ink is ejected, and the power of the laser beam is decreased. When, on the contrary, in the OHP sheet mode, wherein the ink is not easily absorbed, the quantity of the ink ejection is decreased, and the image fixing by the laser beam projection is increased.

In addition to the laser beam projection, the resting period in the sheet discharge can be changed.

In addition to the ink ejection control in accordance with the material of the recording medium, the ejection is controlled in accordance with the current ambient temperature, and further the fixing operation by the laser beam projection and the provision of the resting period may be added to enhance the image fixing.

According to the present invention, the following advantageous effects are provided.

Since the light projected on the recording medium is laser light in an aspect thereof, the temperature rise does not occur in the laser source itself functioning as the drying and fixing means and in the recording head, and therefore, the clogging of the recording head can be prevented, and in addition, the projection area can be limited to assuredly dry the limited area.

Since the laser source is mounted on the recording head in another aspect, the laser beam can be projected assuredly to all of the required portions with small energy. Therefore, the temperature by the application of the laser beam is uniform, and the laser beam can be projected with proper temperature to the desired areas.

Since the laser light is projected in response to the record signal in a further aspect, there is no wasteful heating.

The paper or sheet is discharged a predetermined period after the end of the recording, the ink of the record can be sufficiently fixed.

As a result, the unfixed ink is prevented from contaminating the sheet discharging passage of the recording apparatus or from degrading the record quality by the contamination of the recording medium by the contact with the sheet discharging passage.

The present invention particularly notes the position of the meniscus of the recording liquid adjacent the ejection outlet in accordance with the temperature. At least one of the level and the time period of the applied energy to the piezoelectric element when the recording liquid chamber is expanded is controlled by control means to be so changed that it decreases with increase of the detected temperature, by which the position of the ink meniscus is maintained constant. Therefore, even if the temperature changes, the meniscus position is stably maintained to improve the ejection of the recording liquid, thus enhancing the image quality of the record. In addition, the air is prevented from entering the pressure chamber through the nozzle opening, which had been previously possible due to the viscosity change, thus maintaining the good ink ejection to assure the recording operation.

Since the ink ejection is controlled in accordance with the material of the recording medium, the fixing of the ink can be further enhanced.

The present invention is particularly effective to a bubble jet type recording head among the ink jet recording types.

The typical structure and principle thereof is preferably the one disclosed in U.S. Pat. Nos. 4,723,192 and 4,740,796. Such type is applicable to on-demand type or continuous type, but it is particularly applicable to the on-demand type, since an electrothermal transducer disposed faced to a sheet or liquid passage containing the liquid (ink) is supplied with at least one driving signal corresponding to the recording information to produce immediately a temperature rise beyond nuclear boiling, upon which the thermal energy is produced in the electrothermal transducer, by which film boiling is produced on the heating portion of the recording head, and as a result, a bubble may be formed in the liquid corresponding to each of the driving signals. By the production and contraction of the bubble, the liquid (ink) is ejected through the ejection outlet, so that at least one droplet is formed. When the driving signal is in the form of a pulse, the production and contraction of the bubble is instantaneous and proper, so that the liquid (ink) can be ejected with good response, and therefore, it is preferable. The driving signal in the form of pulse is preferably as disclosed in U.S. Pat. Nos. 4,463,359 and 4,345,262. The good recording is possible when the rate of the temperature rise in the heating surface is as disclosed U.S. Pat. No. 4,313,124.

The structure of the recording head may have the ejection outlet, the liquid passage and the electrothermal transducer (linear or right angle) as disclosed in each of the patents mentioned above, or it may be as disclosed in U.S. Pat. Nos. 4,558,333 and 4,459,600 wherein the heat application portion is in the region where the liquid passage is bent. In addition, a common slit may be used with plural electrothermal transducer, as disclosed in Japanese Laid-Open Patent Application No. 123670/1984, or an opening for absorbing pressure wave of the thermal energy may be formed corresponding to the ejection outlet, as disclosed in Japanese Laid-Open Patent Application No. 138461/1984. In the case wherein the recording head is a full line type having a length corresponding to the maximum width of the recordable medium, it may comprise plural recording heads as disclosed in the above documents, or it may be a single head having the length covering the maximum width. In this case, the present invention is particularly effective.

In addition, the present invention is effective to the case wherein an exchangeable chip type recording head which becomes possible to be supplied with the ink from the main assembly and which becomes possible to be electrically connected thereto, or wherein a cartridge type recording head integrally mounted on the recording head.

Use of recovery means for the recording head or use of preliminary of auxiliary means is preferable to further stabilize the advantageous effects of the present invention. More particularly, capping means, cleaning means, pressing or sucking means, preliminary heating means including an electrothermal transducer and/or another heating element and/or means for providing preliminary ejection mode for performing the ejection operation not for the recording are preferable for the stabilized recording operation.

The recording modes of the apparatus may include a monochromatic recording (black) for example, multicolor mode and/or full-color mode (color mixture) using one integral recording head or plural recording heads. The present invention is effective in such cases.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording apparatus comprising:

a recording head for discharging ink onto a recording material to effect recording thereon in response to a recording signal;

a carriage for carrying said recording head and for scanningly moving said recording head along the recording material;

detecting means for detecting a type of material constituting the recording material;

a light energy source for projecting light energy to the recording material; and control means for selectively effecting projection of the light energy in a first mode in which the light energy is continuously projected and in a second mode in which the light energy is projected intermittently, wherein said control means selectively effects one of the first mode and second mode in accordance with the type of material detected by said detecting means.

2. An apparatus according to claim 1, wherein said light energy source projects the light energy substantially in synchronism with the recording signal.

3. An apparatus according to claim 1, wherein said light energy source projects the light energy to an area of the recording medium on which recording has been effected.

4. An apparatus according to claim 1, wherein said light energy source projects the light energy to an area of the recording medium prior to recording.

5. An ink jet recording apparatus comprising:

a recording head for discharging ink onto a recording material to effect recording thereon in a recording operation in response to a recording signal, the recording operation comprising at least one recording unit;

a carriage for carrying said recording head and for scanningly moving the recording head along the recording material;

detecting means for detecting a type of material constituting the recording material;

a light energy source for projecting light energy to the recording material;

control means for selectively effecting projection of the light energy in a first mode in which the light energy is continuously projected and in a second mode in which the light energy is projected intermittently, wherein said control means selectively effects one of the first mode and second mode in accordance with the type of material detected by said detecting means;

feeding means for feeding the recording material to a recording position where the recording material is facing said recording head, for feeding the recording material by said recording head during the recording operation, and for discharging the recording material from the recording position upon completion of the recording operation; and feed control means for controlling said feeding means for stopping the recording material after completion of one recording unit and resuming feeding of the recording material after a predetermined delay.

6. An apparatus according to claim 5, wherein an end of recording operation terminates upon the completion of a single recording unit.

7. An apparatus according to claim 5, wherein the recording operation is comprised of more than one recording unit.

8. An apparatus according to claim 5, wherein the recording unit corresponds to one sheet of the recording material.

9. An apparatus according to claim 5, wherein the recording unit corresponds to one page of the recording material, which is in a form of rolled paper.

10. An apparatus according to claim 5, wherein the recording material is OHP film.

11. An apparatus according to claim 5, wherein the recording material is OHP film, and the predetermined delay is 1–30 sec.

12. An ink jet recording apparatus comprising:

a recording head for effecting recording in a recording operation by discharging ink, said recording head being operable in a first mode in which a first predetermined quantity of ink is discharged and in a second mode in which a second predetermined quantity of ink is discharged, said second quantity being smaller than said first quantity of ink;

detecting means for detecting a type of recording material on which recording is effected;

feeding means for feeding the recording material to a recording position where the recording material is facing said recording head, for feeding the recording material past said recording head during the recording operation, and for discharging the recording material from the recording position upon completion of the recording operation, wherein a time period from completion of the recording operation to discharging of the recording material is varied depending on the recording mode;

a light energy source for projecting light energy to an area of the recording material; and control means for controlling the light projection in accordance with an output of said detecting means.

13. An apparatus according to claim 12, wherein said detecting means simultaneously detects a presence or absence of the recording material, and is disposed at least at one position of a conveying passage for the recording material, the at least one position including a sheet feeding position, the recording position and a recording material discharging position, wherein said detecting means comprises a light emitting element and a light receiving element between which the recording material is passed, wherein light emitted from said light emitting element is received by said light receiving element via the recording material, and at least one of a type of the recording material and the presence or absence of the recording material is detected on a basis of one of a comparison of a quantity of light received by said light receiving element with a reference level and of an output waveform.

14. An apparatus according to claim 12, wherein said detecting means simultaneously detects the presence or absence of a recording material, and is disposed at least at one position in a recording material conveying passage, the at least one position including a recording material feeding position, the recording position and a recording material discharging position, said detecting means comprises a light emitting and a light receiving element, and wherein light emitted by said light emitting element to the recording material is received by said light receiving element, wherein at least one of a type of the recording material and the presence or absence of the recording material is detected on a basis of one of a comparison of a quantity of light received by said light receiving element with a reference level and of a waveform thereof.

15. An apparatus according to claim 13, wherein said detecting means is disposed between the recording material feeding position and the recording position.

16. An apparatus according to claim 12, wherein said detecting means can detect a first recording material having a relatively low optical transmissivity and a second recording material having a relatively high optical transmissivity.

17. An apparatus according to claim 16, wherein the first recording material has a relatively high ink accepting property, and said second recording material has a relatively low ink acceptance property.

18. An apparatus according to claim 17, wherein said feeding means includes conveying means for conveying the recording material and means for varying a time period for each recording unit.

19. An apparatus according to claim 12, wherein the end of the recording operation is the end of a recording unit.

20. An apparatus according to claim 12, wherein an end of recording operation is before the recording material is discharged.

21. An apparatus according to claim 17, wherein one recording unit corresponds to one sheet of the recording material.

22. An apparatus according to claim 18, wherein one recording unit corresponds to one page of the recording material, which is in a form of rolled paper.

23. An apparatus according to claim 18, the time period is 3–30 sec.

24. An apparatus according to claim 12, wherein said light energy source projects light energy in a recording area of the recording material which is going to be subjected to the recording operation.

25. An apparatus according to claim 12, wherein said light energy source projects light energy to a recording area of the recording material which has been subjected to the recording operation.

26. An apparatus according to claim 12, wherein said recording head is operated in the first recording mode when said detecting means detects that the recording material is one of plain paper or a film having an ink accepting layer, and is operated in the second recording mode when said detecting means detects that the recording material is OHP film.

27. An apparatus according to claim 12, wherein said recording head includes a piezoelectric element and a recording liquid chamber communicating with an ejection outlet, and wherein the piezoelectric element is supplied with electric energy to expand and thereafter, contract the recording liquid chamber, by which ink is ejected through the ejection outlet.

28. An apparatus according to claim 27, further comprising ink temperature detecting means for detecting a temperature of the ink, and at least one of a level or an application period of electric energy supplied to the piezoelectric element when the recording liquid chamber is to be expanded, is controlled in accordance with an output of said temperature detecting means.

29. An apparatus according to claim 28, wherein at least one of the level or the application period of electric energy supplied to the piezoelectric element when the recording liquid chamber is expanded is controlled in accordance with an output of the ink temperature detecting means to provide a constant position of a meniscus of the recording liquid in said recording head irrespective of whether said recording head is operating in the first recording mode or the second recording mode.

30. An ink jet recording apparatus for recording on a recording material using an ink jet recording head for discharging ink onto the recording material, said apparatus comprising:

discriminating means for discriminating whether the recording material is one of plain paper or a transparent sheet;

a driver for driving the recording head in a first mode when said discriminating means discriminates plain paper and in a second mode when said discriminating means discriminates a transparent sheet;

a light energy source for selectively projecting light energy to an area of the recording material; and control means for activating said light energy source when said discriminating means discriminates a transparent sheet.

31. An ink jet recording apparatus for recording on a recording material using an ink jet recording head for discharging ink to make a record on the recording material, said apparatus comprising:

feeding means for feeding the recording material;

means for discriminating one of a presence of the recording material and a type of material constituting the recording material in a discriminating operation;

a light energy source for fixing the record made by the recording head by application of light energy, wherein said discriminating means effects the discriminating operation using the light energy from said light energy source, said light energy being reflected by the recording material.

32. An ink jet recording apparatus for recording on a recording material, said apparatus comprising:

a recording head having an ink passage;

an ink discharging outlet at an end of said ink passage;

a piezoelectric element provided in said ink passage;

temperature detecting means for detecting a temperature of ink;

drive control means for supplying electric energy to said piezoelectric element to discharge the ink and having means for controlling one of a level and a supply time of the electric energy in accordance with an output of said temperature detecting means;

detecting means for detecting a type of material constituting the recording material;

a light energy source for projecting light energy to an area of the recording material;

control means for controlling an operational mode of the light energy source between a continuous projection mode and an intermittent projection mode, wherein said control means controls the light source in one of the continuous mode and intermittent projection mode in accordance with the type of material detected by said detecting means.

33. An ink jet recording apparatus comprising:

a recording head for discharging ink in a recording operation, said recording head including an ink passage in which a piezoelectric element is provided and communicating with an ink discharging outlet;

temperature detecting means for detecting a temperature of ink;

drive control means for supplying electric energy to said piezoelectric element to discharge the ink and having means for controlling said recording head in one of a level and a supply time of the electric energy in accordance with an output of said temperature detecting means;

detecting means for detecting a type of material constituting the recording material;

feeding means for feeding the recording material to a recording position where the recording material is facing said recording head, for feeding the recording material by said recording head during the recording operation, and for discharging the recording material from the recording position upon completion of the recording operation, wherein the time period from completion of the recording operation to the discharging of the recording material is varied in accordance with an output of said detecting means;

a light energy source for projecting light energy to an area of the recording material; and control means for controlling an operational mode of the light energy source between a continuous projection mode and an intermittent projection mode in accordance with the type of material detected by said detecting means.

* * * * *

UNITED STATES PATENT AND TRADEMARK OFFICE

CERTIFICATE OF CORRECTION

PATENT NO. : 5,130,726

DATED : July 14, 1992

INVENTOR(S) : KYOKO FUKUSHIMA, ET AL.

Figure 18A:
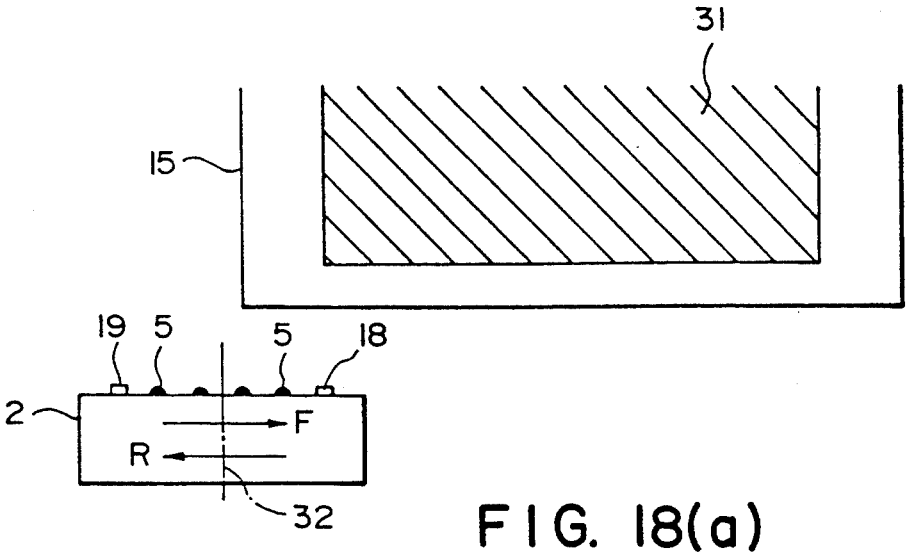
FIGS. 18(*a*) and 18(*b*) illustrates an operation of an ink jet recording apparatus.
Figure 18B:
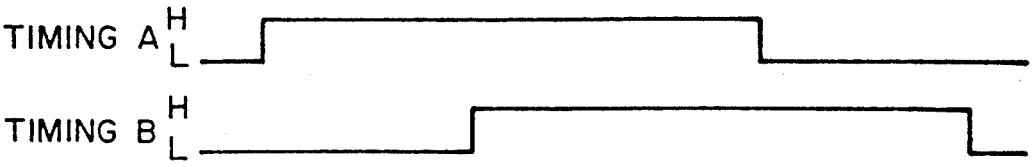

It is certified that error appears in the above-identified patent and that said Letters Patent is hereby corrected as shown below:

COLUMN 6:

Line 22, "illustrates" should read --illustrate--;

Line 24, "19(1) 19(3) are a timing charts" should read --19(1)-19(3) are timing charts--;

Line 48, "illustrates" should read --illustrate--;

Line 52, "illustrates" should read --illustrate--;

Line 62, after "invention." insert as a new paragraph:

--As is apparent to those skilled in the art, Figures 16(a)-16(c), 29(A) and 29(B), and 30(A) and 30(B) are groups of related graphs, with each group having a common time axis. Similarly, Figures 19(1)-19(3) are related drawings having a common x-axis. Figures 18(a) and 18(b) are related drawings with the amplitudes of the timing charges of Figure 18(b) corresponding to positions of the recording medium 15 of Figure 18(a).--.

COLUMN 11:

Line 38, "apparatus" should read --apparatus.--.

UNITED STATES PATENT AND TRADEMARK OFFICE

CERTIFICATE OF CORRECTION

PATENT NO. : 5,130,726

DATED : July 14, 1992

INVENTOR(S) : KYOKO FUKUSHIMA, ET AL.

It is certified that error appears in the above-identified patent and that said Letters Patent is hereby corrected as shown below:

COLUMN 12:

Line 2, "by" should read --in--;

Line 38, "abovedescribed" should read --above-described--.

COLUMN 16:

Line 4, "201" should read --202--;

Line 21, "it" should read --its--;

Line 52, "elapsed" should read --elapses--.

COLUMN 17:

Line 66, "abovedescribed" should read --above-described--.

COLUMN 18:

Line 43, "is" should be deleted; "equal" should read --equals--;

Line 46, "equal 12" should read --equals 12--; "$t_{40}$ near equal 7" should read --$t_{40}$ nearly equals 7--;

Line 49, "equal 14" should read --equals 14--.

UNITED STATES PATENT AND TRADEMARK OFFICE

CERTIFICATE OF CORRECTION

PATENT NO. : 5,130,726 Page 3 of 3

DATED : July 14, 1992

INVENTOR(S) : KYOKO FUKUSHIMA, ET AL.

It is certified that error appears in the above-identified patent and that said Letters Patent is hereby corrected as shown below:

COLUMN 25:

Line 9, "the" should read --an--;

Line 10, "the" (first occurrence) should be deleted; and "end" should read --completion--;

Line 15, "claim 17," should read --claim 18,--.

Signed and Sealed this

Nineteenth Day of October, 1993

Bruce Lehman

*Attest:*

BRUCE LEHMAN

*Attesting Officer*

*Commissioner of Patents and Trademarks*